United States Patent [19]

Sramek

[11] 4,211,054

[45] Jul. 8, 1980

[54] CARTONER FOR ELONGATED ARTICLES AND COMPONENTS THEREOF

[75] Inventor: Elmer D. Sramek, Cicero, Ill.

[73] Assignee: Redington Inc., Chicago, Ill.

[21] Appl. No.: 939,249

[22] Filed: Sep. 5, 1978

[51] Int. Cl.[2] ..... B65B 1/32; B65B 63/02

[52] U.S. Cl. ..... 53/502; 53/529; 53/566; 53/236; 53/252; 198/653; 198/706

[58] Field of Search ..... 53/148, 236, 252, 251, 53/250, 566, 529, 502; 198/706, 653

[56] References Cited

U.S. PATENT DOCUMENTS

| | | | |
|---|---|---|---|
| 811,125 | 1/1906 | Bucher | 198/706 |
| 2,778,476 | 1/1957 | Engleson et al. | 198/35 |
| 3,122,071 | 2/1964 | Vogel | 93/53 |
| 3,279,147 | 10/1966 | Garapolo | 53/252 |
| 3,333,396 | 8/1967 | Paal et al. | 53/252 |
| 3,540,570 | 11/1970 | Osterdahl et al. | 198/653 |
| 3,879,920 | 4/1975 | Langen | 53/252 X |

*Primary Examiner*—Travis S. McGehee

*Attorney, Agent, or Firm*—Vogel, Dithmar, Stotland, Stratman & Levy

[57] ABSTRACT

A cartoner for elongated articles including a source of a series of unshaped bundles thereof, a first conveyor having first article buckets thereon with a first reach adjacent to the source of articles so that each first article bucket receives an unshaped bundle of articles therein, a second conveyor having a set of second article buckets each having at least one wall shiftable between receiving and shaping positions with a first reach of the second conveyor adjacent to the first reach of the first conveyor so that each of the second article buckets receive an unshaped bundle of articles from one of the first article buckets, a leveling plate for leveling the contents of the second article bucket with the wall in the shaping position thereof, a set of filler members on the second conveyor for pushing the elongated articles from the second article bucket into a carton on an adjacent carton conveyor, and suitable control mechanism for causing the proper interaction of the various conveyors and parts thereof.

34 Claims, 30 Drawing Figures

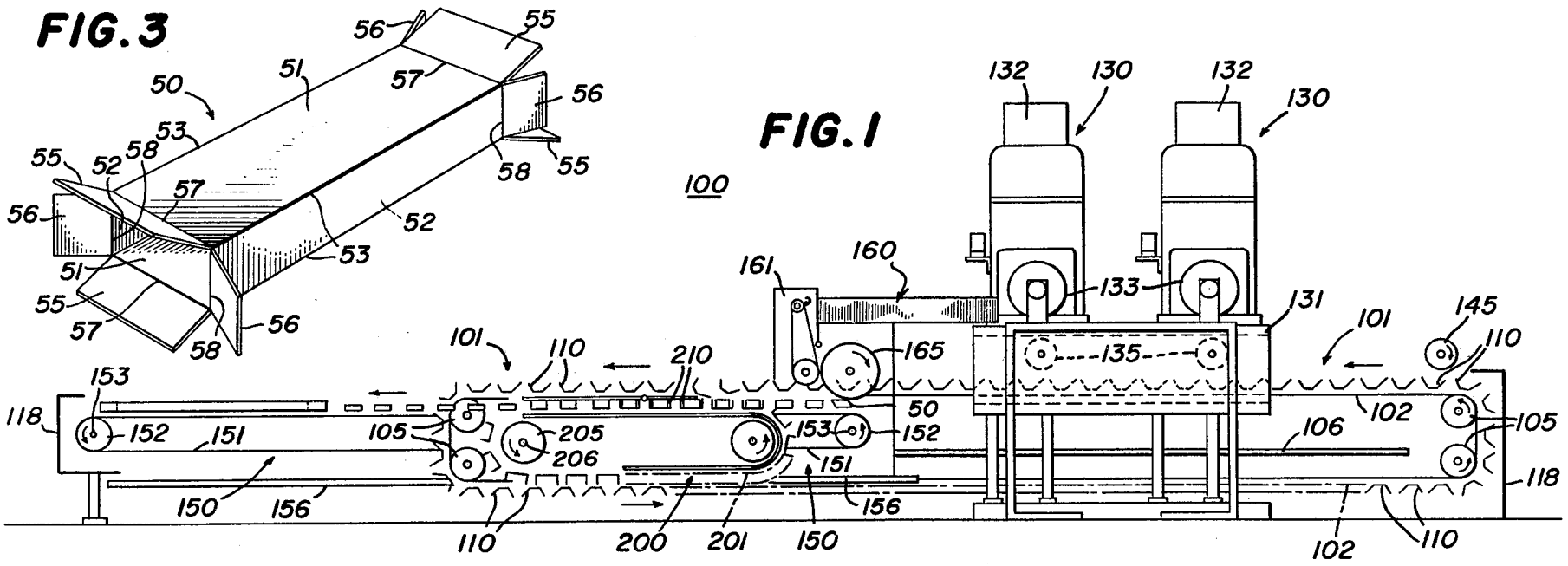
FIG. 1
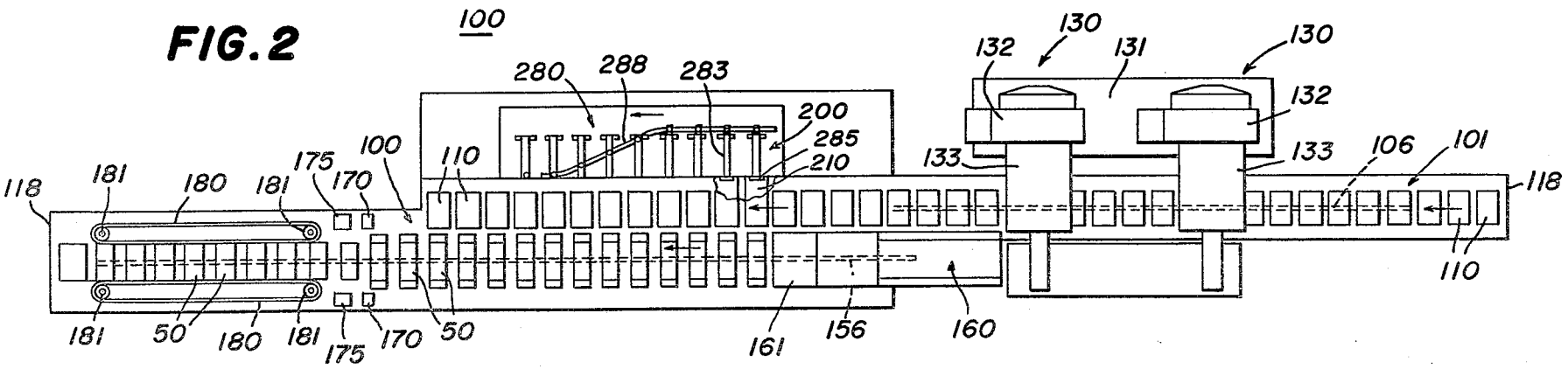
FIG. 2
FIG. 3

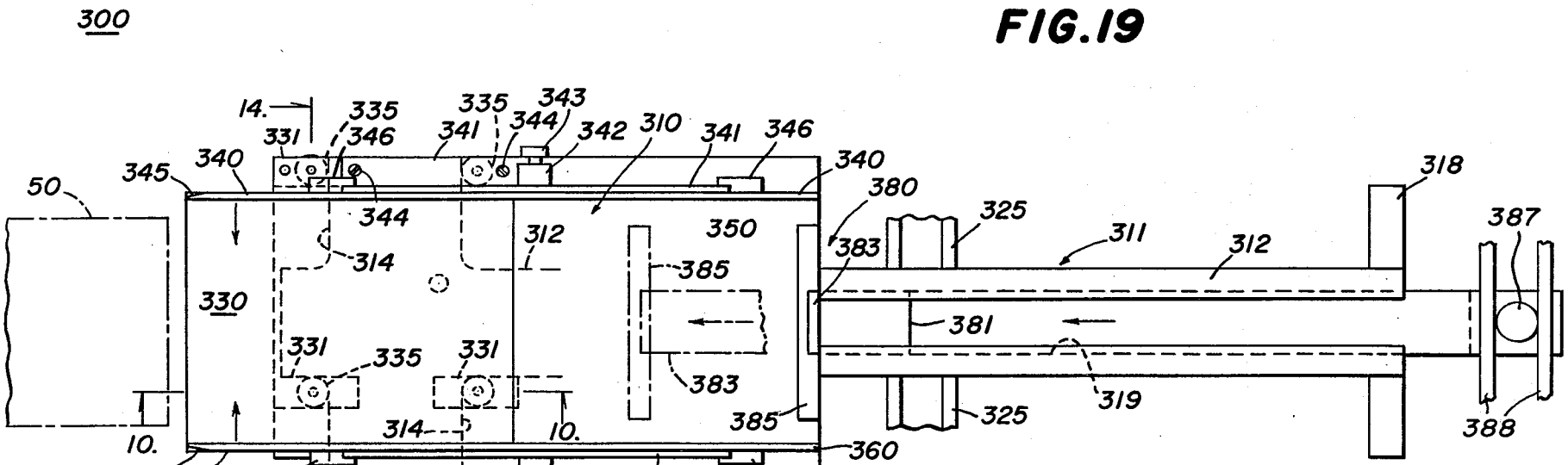
FIG.19
300
50
310
311
312
313
314
318
319
325
330
331
335
340
341
342
343
344
345
346
350
360
361
362
363
364
365
366
380
381
383
385
387
388
10.
14.
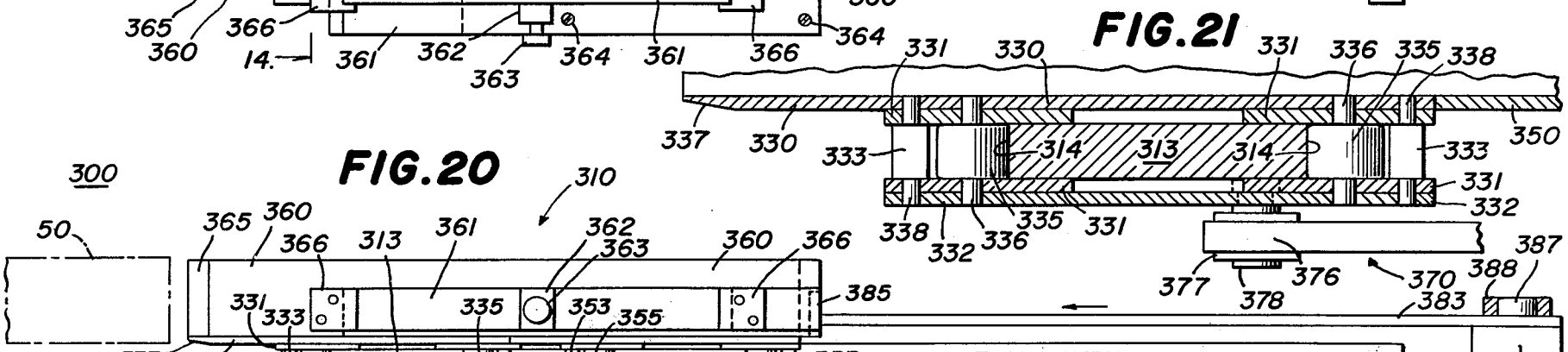
FIG.21
FIG.20
300
50
301
302
303
307
308
310
311
313
314
315
316
317
318
320
321
322
330
331
332
333
335
336
337
338
350
351
352
353
355
360
361
362
363
365
366
370
371
373
375
376
377
378
381
382
383
385
387
388

CARTONER FOR ELONGATED ARTICLES AND COMPONENTS THEREOF

BACKGROUND OF THE INVENTION

The present invention relates generally to cartoners, and specifically to cartoners for use in cartoning bundles of elongated articles wherein the bundles have a predetermined shape.

Such cartoning machines heretofore have required the use of accurately machined and shaped buckets into which the elongated articles were placed for shaping into the desired bundle before insertion into a carton on an adjacent carton conveyor. The accurately machined and shaped buckets were very expensive to manufacture. This was particularly disadvantageous because in certain installations, the article conveyor had to be quite long, thus requiring a correspondingly large number of the accurately machined and shaped buckets.

The long article conveyors were necessitated by the fact that occasionally each article bucket had to go past more than one product weighing unit, this requiring a substantial reach of the article conveyor, with the corresponding increase in the number of expensive article buckets.

In yet other installations, it was desired to increase the production rate. A typical such installation was that for cartoning spaghetti, wherein a predetermined charge of spaghetti was placed into a bundle, the charge of spaghetti being regulated by weight from a weighing machine, such as the well known Hesser machine. If article conveyor speeds of as much as 180 cartons per minute were to be realized, two such weighing machines were provided placing the charges respectivey into alternate buckets on the article conveyor. If a speed of 250 cartons per minute was required, then three weighing machines were needed, and if a speed of 300 cartons per minute was required, then four weighing machines were required, the weighing machines depositing the weighed bundle of spaghetti into every third or every fourth article bucket, as the case may be. The speed of operation of the weighing machines also is determined by the weight of the product per carton, smaller weights permitting higher speeds, and larger weights requiring slower speeds. The provision of additional weighing machines require a lengthening of the article conveyor, and thus the utilization of many more of the expensive article buckets.

SUMMARY OF THE INVENTION

The present invention provides an improved cartoner for high speed cartoning of elongated articles, including fragile articles such as spaghetti.

This is accomplished in the present invention, and it is an object of the present invention to accomplish these desired results, by providing a handling mechanism for unshaped bundles of elongated articles including a source of a series of predetermined unshaped bundles of elongated articles, a first continuous conveyor having a set of first article buckets thereon, the first conveyor having a first reach adjacent to the source of unshaped bundles of articles, the set of first article buckets while traveling along the first reach of the first conveyor each receiving an unshaped bundle of articles therein, a second continuous conveyor having a set of second article buckets thereon, each of the second article buckets having at least one wall shiftable with respect to the other walls thereof between a retracted receiving position and a closed shaping position corresponding to the width of the carton to be filled, the second conveyor having a first reach adjacent to the first reach of the first conveyor, the set of second article buckets while traveling along the first reach of the second conveyor each receiving an unshaped bundle of articles therein from an associated one of the first buckets, and control mechanism for the second article buckets for placing the one wall in the retracted receiving position while receiving an unshaped bundle of articles in the associated second article bucket and for thereafter moving the one wall to the closed shaping position thereof to arrange the unshaped bundle into a bundle having a predetermined desired shape.

Another object of the invention is to provide a handling mechanism of the type set forth and further including a set of filler members mounted upon the second conveyor and each having a filler tip in alignment with one of the second article buckets and shiftable between a retracted receiving position and an extended filling position, the control mechanism placing the one wall of each second article bucket in the retracted receiving position for receiving an unshaped bundle of articles therein and thereafter moving the one wall to the closed shaping position thereof to arrange the unshaped bundle into a bundle having a predetermined desired shape and dimension, the control mechanism also placing the filler member in the retracted receiving position thereof for receiving an unshaped bundle of articles in the associated second article bucket and while the one wall thereof moves to the closed shaping position thereof and thereafter moving the filler member to the extended filling position thereof to eject the shaped bundle of articles from the associated article bucket and into a carton on an adjacent carton conveyor.

In conjunction with the foregoing object, another object of the invention is to provide a handling mechanism of the type set forth wherein the filler tips in the retracted receiving positions thereof are still disposed within the adjacent end of the associated article bucket, whereby there is no possibility of misalignment between the filler tip and the associated article bucket, thus adapting the handling mechanism for the handling of a small diameter product wherein a close fit is necessary between the filler tip and the walls of the associated article bucket.

Still another object of the invention is to provide a handling mechanism for elongated articles of the type set forth, and further including a leveling plate mounted adjacent to the second conveyor at a point therealong reached by the article buckets after the one wall is in the closed shaping position thereof and positioned just above the upper edges of the walls of the second article buckets to level the bundle of articles therein.

In connection with the foregoing object, it is another object of the invention to provide a handling mechanism for elongated articles of the type set forth wherein the leveling plate has a hinged section hinged to the end thereof disposed toward the oncoming article buckets and engaging the articles therein to assist in leveling the same within the associated article bucket, a second control mechanism responsive to an upward tilting of the hinged section due to the contact thereof with an excess quantity of articles in an article bucket thereunder for stopping the article conveyors.

Yet another object of the invention is to provide a cartoner for bundles of elongated articles of the type set forth utilizing handling mechanism for elongated articles of the type set forth herein above, and further including a carton conveyor for conveying open cartons from a source thereof along a reach wherein an open carton is in lateral alignment with each of the second article buckets having the one wall thereof in the closed shaping position thereof.

Further features of the invention pertain to the particular arrangement of the parts of the cartoner and the handling mechanism incorporated therein, whereby the above outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

FIG. 1 is a front elevational view of a cartoner for cartoning elongated articles, such as spaghetti, the cartoner being made in accordance with and embodying the principles of the present invention;

FIG. 2 is a plan view of the cartoner of FIG. 1;

FIG. 3 is a perspective view of a carton useful in the cartoner of FIGS. 1 and 2;

FIG. 19 is a plan view of a second embodiment of an article bucket with movable walls and the associated filler mechanism therefor, all made in accordance with and embodying the principles of the present invention;

FIG. 20 is a side elevational view of the apparatus of FIG. 19;

FIG. 21 is an enlarged view in vertical section along the line 21—21 of FIG. 19;

DESCRIPTION OF THE PREFERRED EMBODIMENTS

Figure 4:
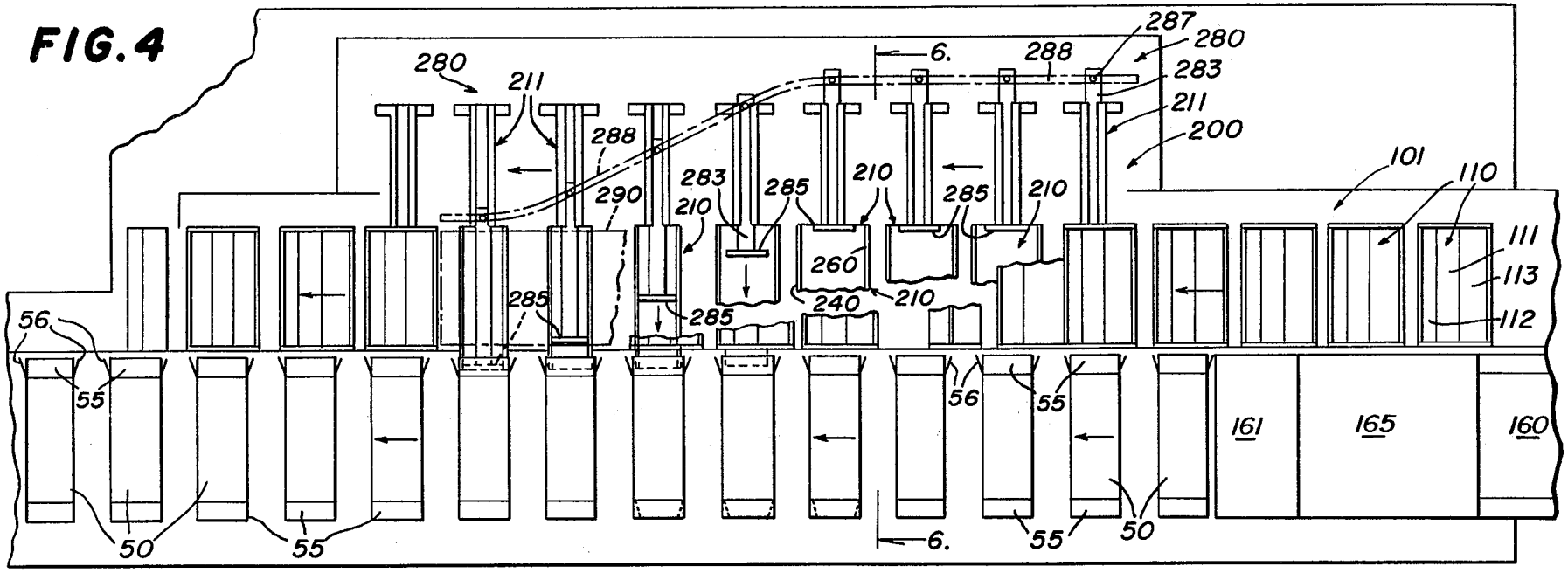
FIG. 4 is a plan view on an enlarged scale of the handling mechanism including the bundle shaping buckets, the filler mechanism and a portion of the carton conveyor.

There is illustrated in FIGS. 1 and 2 the drawings a cartoner 100 for shaped bundles of elongated articles, such as spaghetti, the cartoner 100 being made in accordance with and embodying the principles of the present invention. The cartoner 100 includes a tippable bucket conveyor 101 that carries a plurality of tippable buckets 110 along a path under Hesser product weighers 130 and then over a combination article and filler conveyor 200, and specifically over a plurality of article buckets 210 thereon. A part of the combination conveyor 200 is a plurality of filler members 280 having filler tips 285 associated respectively with each of the article buckets 210, the filler members 280 serving to push the shaped bundle of spaghetti from the associated article bucket 210 into an open carton 50 on an adjacent carton conveyor 150. The carton conveyor 150 then passes by a glue applicator 170, a flap folding mechanism 175 and a pair of setting up belts 180 that serve to close the cartons 50 prior to the delivery thereof to the discharge end of the carton conveyor 150.

The cartoner 100 of the present invention is particularly adapted for cartoning elongated articles, and especially fragile articles such as spaghetti. It will be appreciated that the cartoner 100 may be used to carton any elongated article, but that it is particularly useful in cartoning fragile articles, such as spaghetti, and will be so described. The elongated articles are to be placed in a carton 50, a typical such carton being illustrated in FIG. 3 of the drawings. The carton 50 includes two opposed main walls 51 joined along the longitudinal edges thereof by opposed side walls 52, fold lines 53 being disposed at the junctures of the walls 51 and 52. The main walls 51 carry on each end thereof an end flap 55 attached thereto at a fold line 57, while the side walls 52 carry on each end thereof a side flap 56 attached thereto at a fold line 58.

Figure 5:
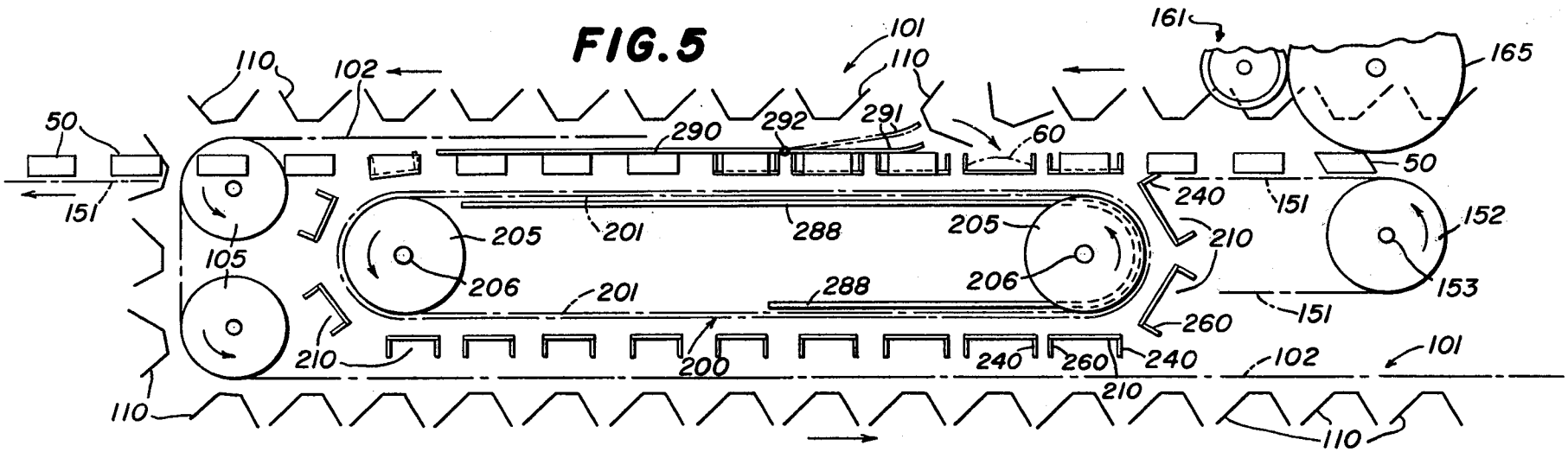
FIG. 5 is a front elevational view of the structure shown in FIG. 4.
Figure 7:
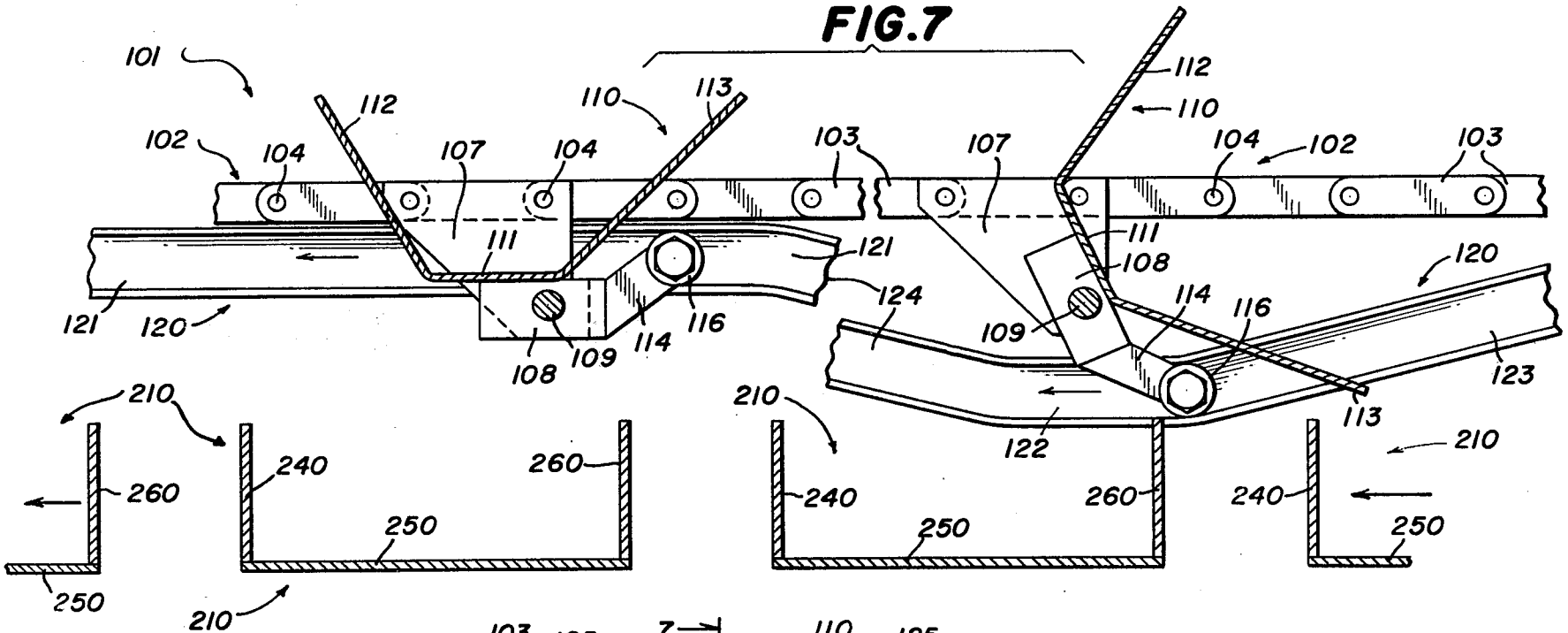
FIG. 7 is an enlarged view in longitudinal vertical section, with certain parts broken away, along the line 7—7 of FIG. 6.
Figure 6:
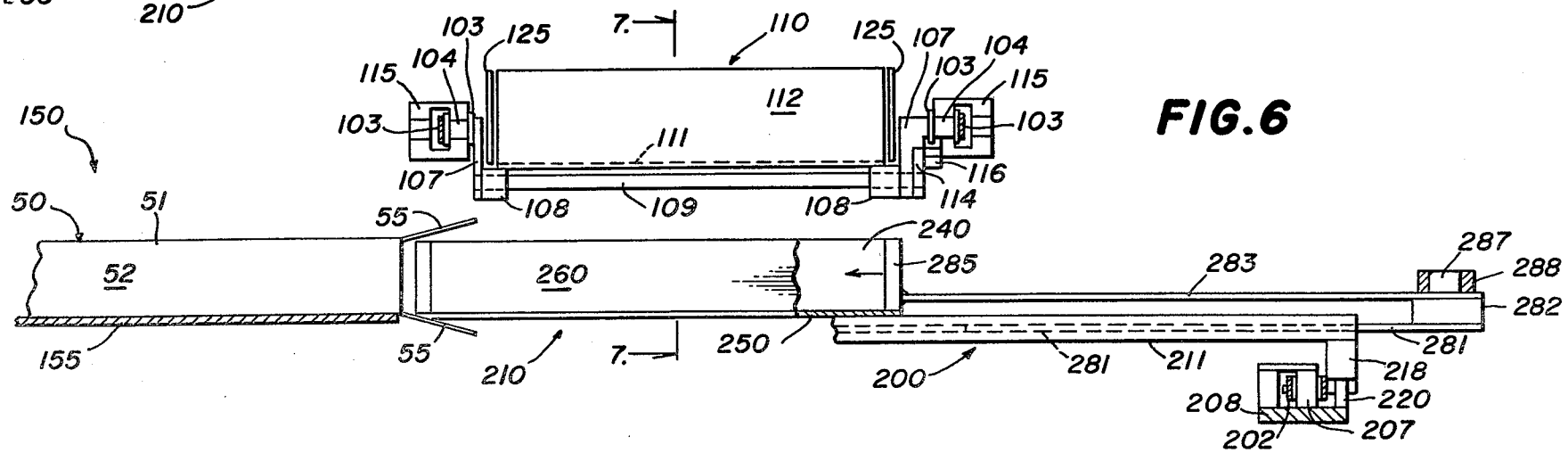
FIG. 6 is a view in transverse section through the cartoner of FIG. 4 in the direction of the arrows along the line 6—6 thereof.

Further details of the tippable bucket conveyor 101 are illustrated in FIGS. 4 to 7 of the drawings. Referring particularly to FIGS. 6 and 7, it will be seen that the conveyor 101 includes two laterally spaced-apart conveyor chains 102 each formed of a plurality of links 103 interconnected by pins 104. The conveyor chains 102 are guided and driven by sprockets 105 (see FIG. 1) from a drive shaft 106 through a connection not shown. There are provided at spaced along points on the conveyor chains 102 attachment brackets 107. Laterally aligned attachment brackets 107 have associated therewith laterally spaced-apart mounting blocks 108 pivotally supported on the attachment brackets 107 by a pivot shaft 109 mounted thereon.

Each pair of mounting blocks 108 has an article bucket 110 mounted thereon, each bucket 110 including a bottom wall 111 mounted on the blocks 108, a front wall 112 extending upwardly from the bottom wall 111 at an obtuse angle of about 120°, and a back wall 113 extending upwardly from the bottom wall 111 at an obtuse angle of about 130°. Disposed on one end of the pivot shaft 109 is an arm 114 carrying at the outer end a cam roller 116 which is disposed in a cam track 120. As can be best seen in FIG. 7, the cam track 120 includes a high portion 121, a low portion 122, a down transition portion 123 and an up transition portion 124, the purpose of which will be described more fully hereinafter. The conveyor chains 102 are guided by guides 115 and the entire tippable bucket conveyor is mounted on a suitable frame 118 (see FIG. 1). There also are disposed at either end of the tippable buckets 110 guides 125 (see FIG. 6).

An unshaped bundle of elongated articles, such as spaghetti, is placed in each of the tippable buckets 110 from one of the Hesser weighers 130. More specifically, each of the product weighers 130 places a predetermined bundle of spaghetti, i.e., a bundle having a predetermined weight, in each of the tippable buckets 110. To this end, two of the Hesser product weighers 130 have been provided mounted upon their base 131 and each having an infeed hopper 132 for receiving bulk quantities of spaghetti. An outfeed 133 is provided for each of the weighers 130 that places a predetermined weight of spaghetti in each of the associated transfer wheels 135 that are disposed over an upper reach of the tippable bucket conveyor 101 adjacent to the right hand thereof as viewed in FIGS. 1 and 2. The transfer wheels 135 serve to place a bundle of predetermined weight of spaghetti in alternate buckets 110. If required, yet a third product weigher can be provided supplying predetermined weighed charges or bundles of spaghetti into buckets from a transfer wheel 135 disposed to the right in FIG. 1.

As the buckets 110 move to the left of the left-hand-most Hesser product weigher 130, each bucket 110 has a bundle of predetermined weight of spaghetti therein, the bundle being unshaped in cross section, although the ends of the elongated articles are in vertical alignment in essentially a common plane.

It is desired to transfer the pre-weighed bundle of spaghetti into one of the cartons 50, and to this end, the carton conveyor 150 has been provided. The carton conveyor 150 includes two spaced-apart conveyor chains 151 (see FIG. 5 also) supported by sprockets 152 carried by shafts 153. The conveyor chains 151 carry carton buckets 155 (see FIG. 6 also), the carton buckets 155 being equidistantly spaced along the conveyor chains 151 and being spaced apart the same distance as the tippable buckets 110 described above. The carton conveyor 150 is driven from a main drive shaft 156 (see FIG. 2).

In order to provide open cartons to the carton conveyor 150, a carton magazine 160 (see FIG. 1) has been provided that holds a plurality of cartons 50 in the flattened condition thereof with the flaps 55 and 56 extending outwardly therefrom, and further with the cartons 50 disposed in a vertical position with one of the edges 53 disposed downwardly. At the lefthand end of the carton magazine 160, as viewed in FIG. 1, is a carton extractor 161 which is operative to remove cartons 50 from the carton magazine 160 one-by-one. A carton 50 withdrawn by the extractor 161 is fed to a four-position expander wheel 165 which opens the carton and places it in one of the carton buckets 155 on the carton conveyor 150.

After the carton 50 has been filled with elongated articles, as will be explained more fully hereinafter, the carton moves to the left as viewed in FIGS. 1 and 2 and first encounters glue applicators 170 disposed adjacent to the carton conveyor 150. The glue applicators 170 apply glue to selected ones of the flaps 55 and 56, after which the flaps are closed by a flap folding mechanism 175. The folded flaps are held in the folded position by two setting up belts 180 contacting respectively the opposite ends of the closed carton 50, the belts 180 being supported by pulleys 181.

Disposed within the upper and lower reaches of the tippable bucket conveyor 101 is the combination article and filler conveyor 200. The conveyor 200 includes two conveyor chains 201 each formed of a plurality of links 202 interconnected by pins 203. The chains 201 are supported by sprockets 205 mounted on shafts 206 (see FIG. 5 particularly). As may be best seen in FIG. 6, each conveyor chain 201 also carries a bearing block 207 that rides upon a support plate 208 so as fully to control the vertical elevation of the upper reaches of the conveyor chains 201.

Mounted upon the conveyor chains 201 is a plurality of article buckets 210, the article buckets 210 being spaced apart a distance that is the same as that of the tippable buckets 110 and the carton buckets 155. Furthermore, the carton buckets 155 and the article buckets 210 along the upper reaches of the conveyors 150 and 201 are in lateral alignment (see FIG. 4).

Figure 15:
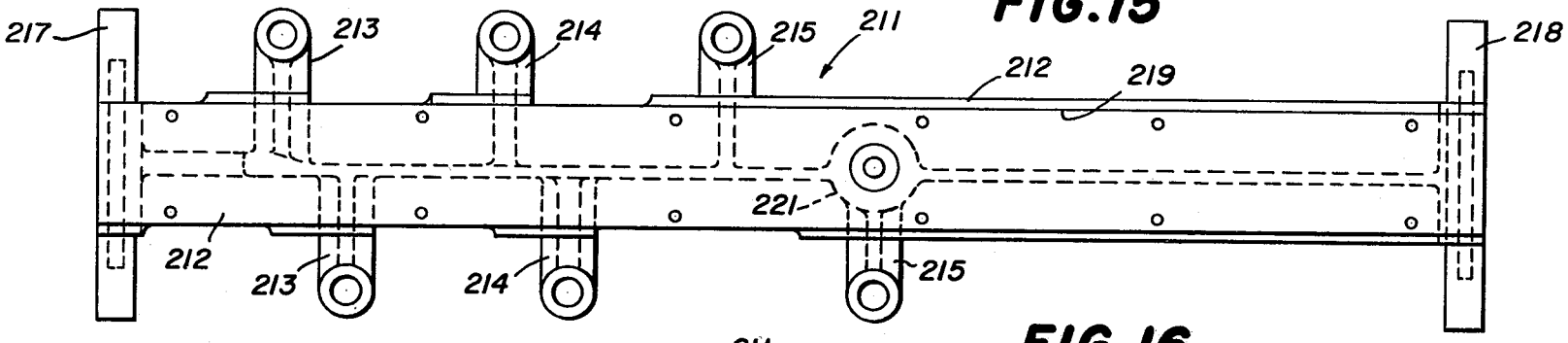
FIG. 15 is a plan view of the article bucket frame and its appendages.
Figure 16:
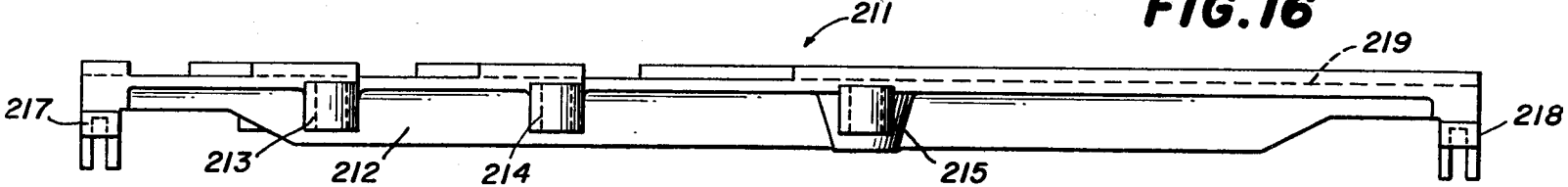
FIG. 16 is a side elevational view of the structure of FIG. 15.
Figure 18:
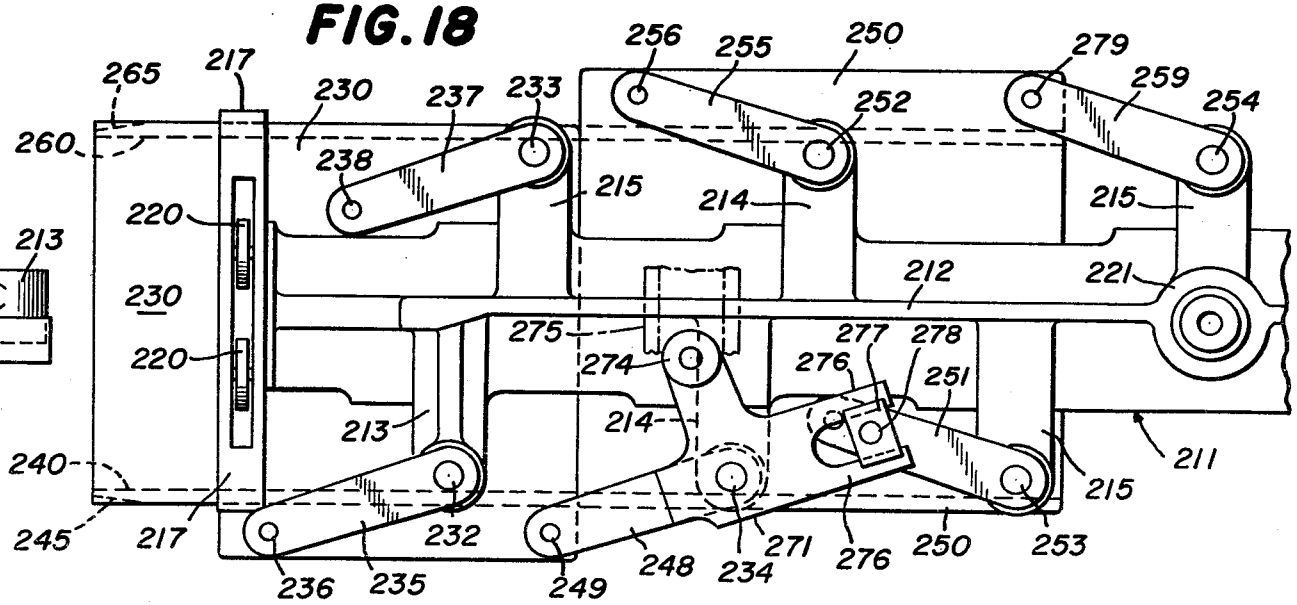
FIG. 18 is a view from the bottom of the mechanism for controlling the position of the sides of the article bucket.
Figure 17:
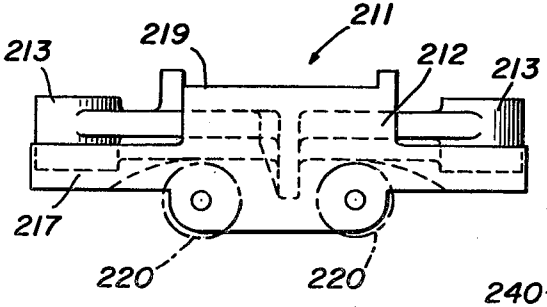
FIG. 17 is an end view of the structure of FIGS. 15 and 16.

Each of the article buckets 210 includes a support base 211, the shape of which is best illustrated in FIGS. 15 and 16 of the drawings, the support base 211 including a longitudinal body 212 having a pair of front side arms 213, a pair of intermediate side arms 214 and a pair of rear side arms 215 extending laterally therefrom. The side arms 213, 214, and 215 disposed below as viewed in FIG. 15 are displaced rearwardly or to the right with respect to the other one of the pairs of arms 213, 214, and 215. A front support block 217 is provided at one end of the support base 211 and a rear support block 218 is provided at the other end, the support blocks 217 and 218 being fixedly secured to the support base 211. A slide 219 extends the entire length of the support base 211 centrally thereof and is formed by suitably shaped pieces secured to the support base 211. Each of the support blocks 217 and 218 further carries pairs of rollers 220 that rest upon the support plates 208 to be carried thereby, and thus to maintain the associated article bucket 210 at the proper vertical position. There further is provided an intermediate embossment 221 that carries a cam roller 222 mounted thereon and riding in a cam track 225 that provides for horizontal positioning of the support base 211 and the associated article bucket 210.

The article bucket 210 further comprises a front bottom wall 230, preferably formed of anodized aluminum, since it comes into contact with the spaghetti product being cartoned, and extending upwardly from the forward (top as viewed in FIG. 8) edge thereof is a removable forward side wall 240 also formed of anodized aluminum. A rear bottom wall 250 is provided immediately to the rear or right, as viewed in FIG. 8, of the front bottom wall 230, the rear bottom wall 250 also being formed of anodized aluminum, and carrying an upstanding rearward side wall 260 formed of anodized aluminum. The bottom wall 230 and 250 shift longitudinally along an arcuate path, i.e., longitudinally in the direction of travel of the conveyor 200, in order to move the attached side walls 240 and 260 toward and away from each other during the shaping of a bundle of elongated articles contained in the article bucket 210.

In order to accommodate the longitudinal and arcuate shifting of the front bottom wall 230, it is pivotally mounted upon the support base 211 by three mounting levers 235, 237, and 248. The mounting lever 235 is connected at one end by a connector pin 232 to one of the front side arms 213 and at the other end to the front bottom wall 230 by a pin 236 (see FIGS. 10 and 11 particularly). The mounting lever 237 has one end connected by a pin 233 to the other front side arm 213 and has its other end connected by a pin 238 to the front bottom wall 230. Finally, the mounting lever 248 has one end connected by a pin 234 to one of the intermediate side arms 214 and has its other end connected by a pin 249 to the front bottom wall 230.

Figure 8:
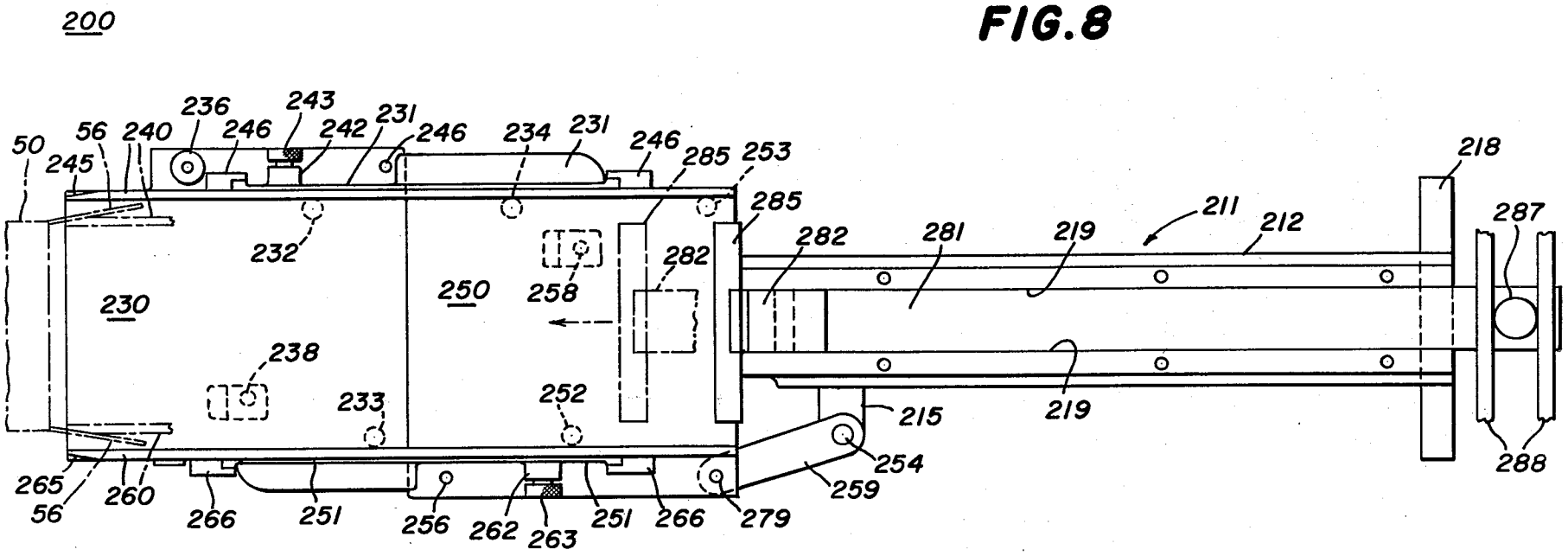
FIG. 8 is a plan view of a first preferred embodiment of an article bucket with movable walls and the associated filler mechanism therefor, all made in accordance with and embodying the principles of the present invention.
Figure 9:
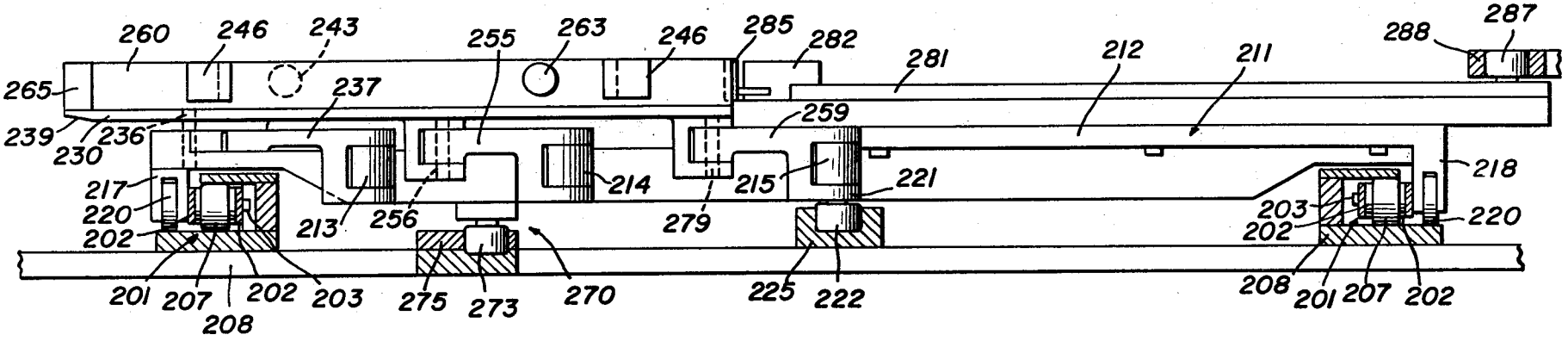
FIG. 9 is a side elevational view of the apparatus of FIG. 8.
Figure 12:
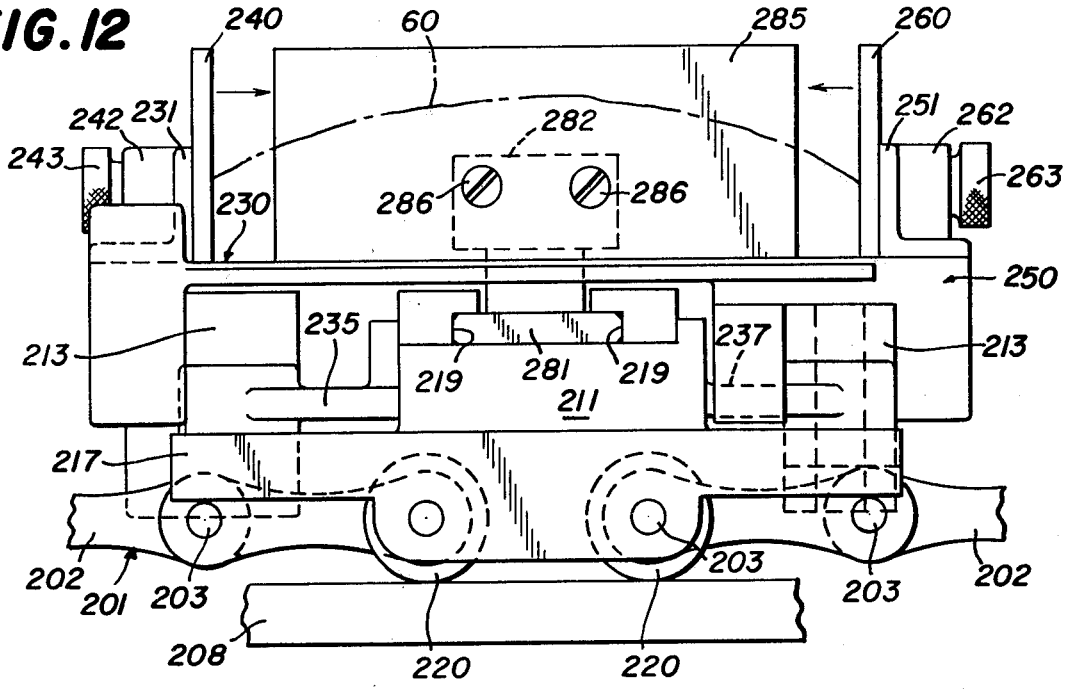
FIG. 12 is a view on an enlarged scale from the left-hand end of the article bucket of FIG, 8.
Figure 13:
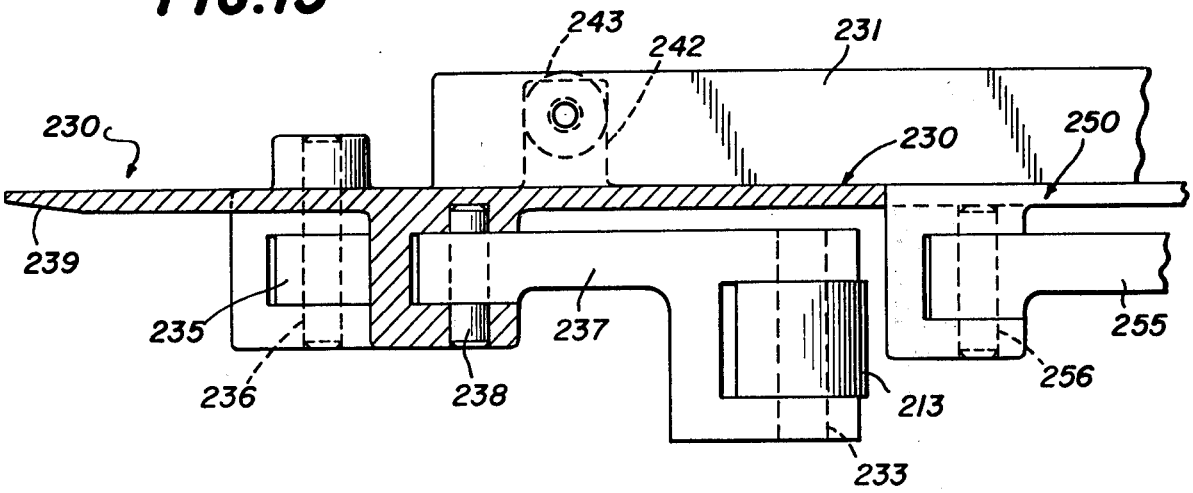
FIG. 13 is a view in vertical section along the line 13—13 of FIG. 10.

The mounting of the forward side wall 240 on the front bottom wall 230 is best illustrated in FIGS. 8, 9, and 12. Fixedly secured to and integral with the front bottom wall 230 is an upstanding side wall mounting flange 231 which carries thereon a mounting boss 242 extending laterally therefrom and receiving a manually actuatable mounting plunger 243. The forward side wall 240 carries a pair of mounting brackets 246 that fit around the opposite ends of the mounting flange 231, and the mounting plunger 243 has an end thereof disposed in an opening in the forward side wall 240. The forward or lefthand end of the side wall 240 is beveled as at 245 to make a better and easier engagement with an associated carton 50, and particularly the flaps thereof.

The rear bottom wall 250 is likewise mounted for arcuate sliding movement with the front bottom wall 230, and to this end three mounting levers 255, 257, and 259 have been provided. The mounting lever 255 has one end connected to the other intermediate side arm 214 by a pin 252 and has the other end connected to the rear bottom wall 250 by a pin 256 (see FIGS. 10 and 11 particularly). The mounting lever 257 has one end connected by a pin 253 to one of the rear side arms 215 and has the other connected to the rear bottom wall 250 by a pin 258. Finally, the mounting lever 259 has one end connected by a pin 254 to the other rear side arm 215 and has its other end connected by a pin 279 to the rear bottom wall 250.

The rearward side wall 260 was mounted on the rear bottom wall 250 by means of a side wall mounting flange 251 integral with the bottom wall 250 and extending upwardly therefrom. Carried on the mounting flange 251 is a mounting boss 262 carrying a manually releasable mounting plunger 263. The rearward side wall 260 carries two spaced-apart mounting brackets 266 that engage the opposite ends of the flange 251 for engagement therewith, the forward end of the mounting plunger 243 engaging in an opening (not shown) in the rearward side wall 260 to maintain the side wall 260 in its mounted position.

Figure 10:
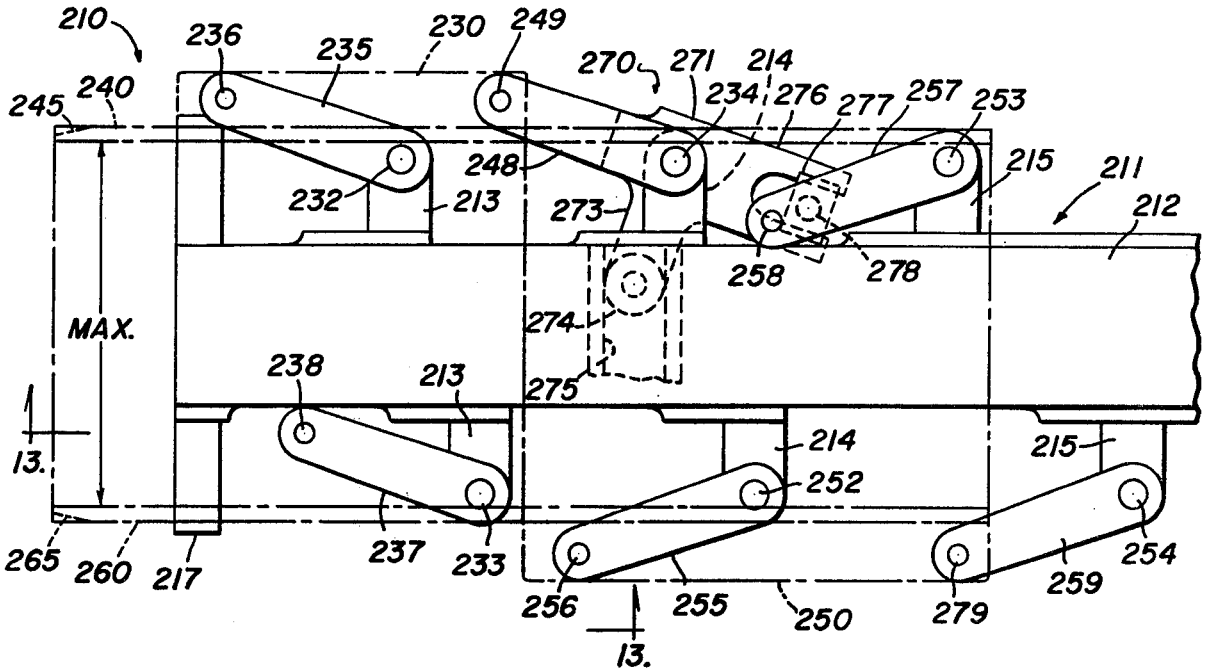
FIG. 10 is an enlarged view with certain parts broken away and removed illustrating the mechanism for moving the walls of the article bucket of FIGS. 8 and 9, the parts being shown with the walls in the maximum spaced-apart condition thereof.
Figure 11:
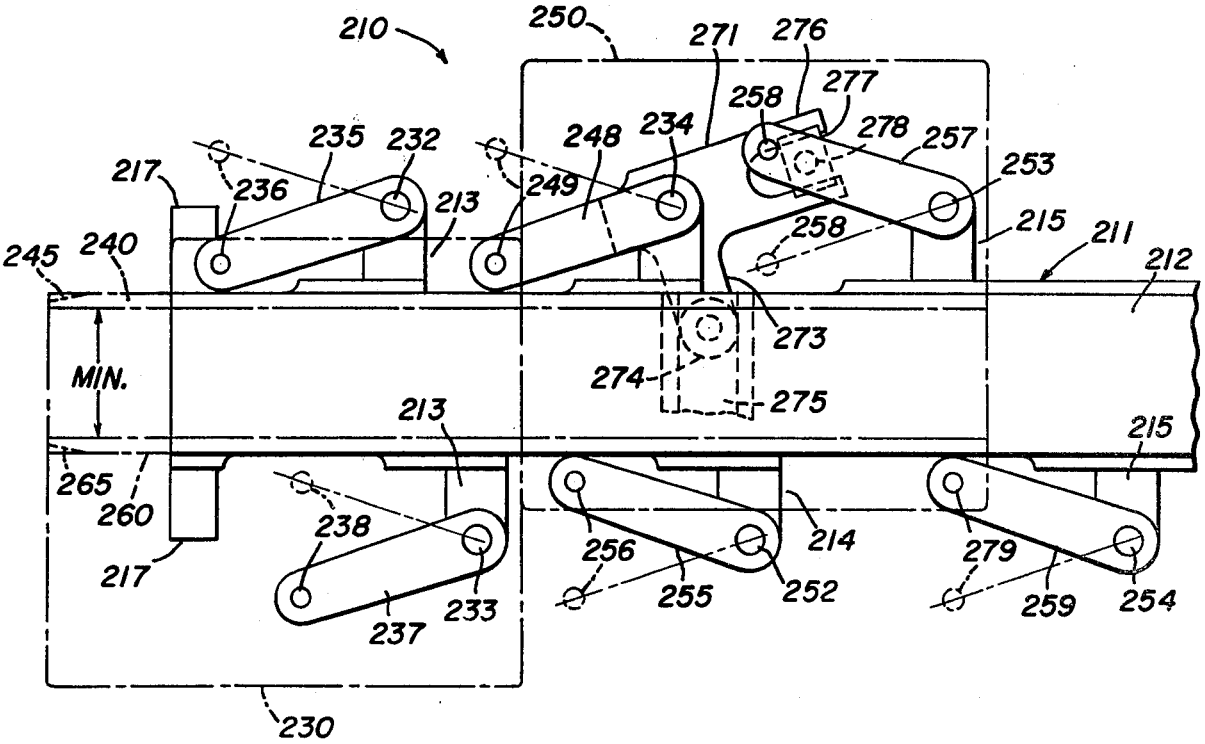
FIG. 11 is a view similar to FIG. 10 but showing the walls of the minimum spaced-apart condition thereof.

The side walls 240 and 260 are movable between the positions illustrated respectively in FIGS. 10 and 11, i.e., between a maximum open position illustrated in FIG. 10 and a minimum closed position illustrated in FIG. 11. To this end, a wall positioning mechanism has been provided including an essentially T-shaped lever 271 that is mounted on one of the side arms 214 by means of the pin 234 and is fixedly secured to the mounting lever 248 associated therewith. The lever 271 has an arm 273 extending substantially normal to the longitudinal axis of the mounting lever 248 and carrying thereon a roller 274 engaging in a cam track 275. The other end of the T-shaped lever 271 is forked as at 276 and carries a sliding block 277 slidable with respect thereto within the forked ends 276, the block 277 being secured to the mounting lever 257 by a pivot pin 278. By properly shaping the cam track 275, the bottom walls 230 and 250 together with the associated side walls 240 and 260 can be moved between the maximum spaced-apart position of FIG. 10 and the minimum spaced-apart position of FIG. 11, and any position therebetween. More specifically, pivoting of the T-shaped lever 271 in a counterclockwise direction as viewed in FIG. 10 shifts the mounting lever 248 counterclockwise and thereby drives the front bottom wall 230 in a counterclockwise direction. Simultaneously, the engagement between the lever 271 and the mounting lever 257 by means of the pivot block 277 moves the mounting lever 257 in a clockwise direction and thereby shifts the rear bottom wall 250 in a clockwise direction as viewed in FIG. 10. The amount of shifting of the bottom walls 230 and 250 is equal and in opposite senses so as to move the side walls 240 and 260 toward and away from each other as the T-shaped lever 271 is moved in a counterclockwise direction and a clockwise direction, respectively.

In order to deliver a shaped bundle 60 of elongated articles from the article bucket 210, each article bucket 210 has associated therewith a filler member 280. More specifically, there is provided in the slot 219 on each support base 211 a slide 281 extending to the left and carrying on the lefthand end thereof a block 282 to which is secured a filler tip 285 by means of screws 286 so that the filler tip can be changed when required so as to accommodate different widths and heights of bundles 60 and correspondingly different widths and heights of cartons 50. The slide 281 also carries a cam roller 287 on the righthand end thereof, the cam roller 287 engaging in a cam track 288. The shape of the cam track 288 is best illustrated in FIGS. 2 and 4 of the drawings, and is shaped so as to cause the contents of the article bucket 210 to be pushed into an associated carton 50 after the bundle of articles has been shaped, all as will be described more fully hereinafter.

Figure 14:
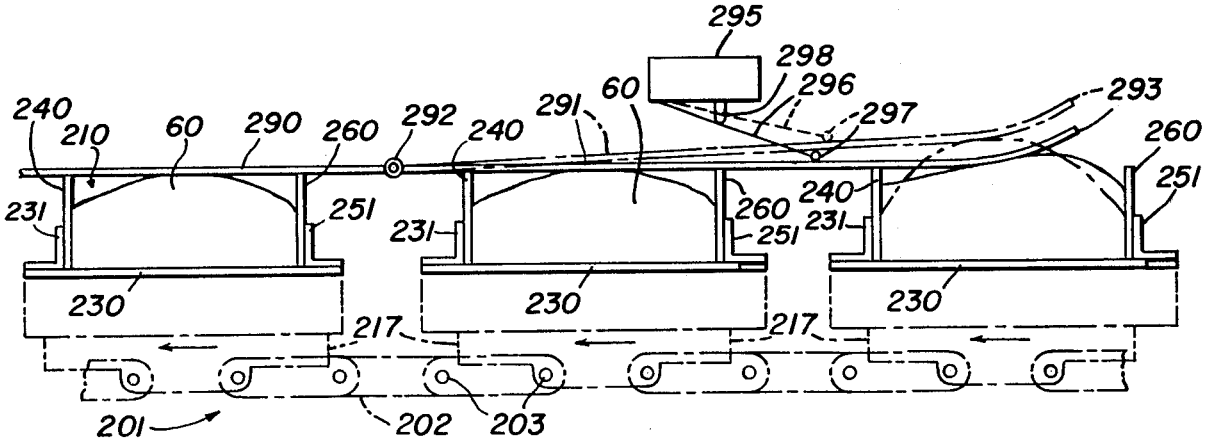
FIG. 14 is a partially diagrammatic view showing several of the article buckets of FIGS. 8 and 9 with movable walls and the association thereof with the leveling plate disposed thereabove.

There is illustrated in FIG. 14 of the drawings a leveling plate 290 which is positioned to contact the bundle of elongated articles before the side walls 240 and 260 have been moved to the inner and shaping positions thereof. The leveling plate 290 has a width essentially equal to that of the associated article buckets 210 and covers a plurality of the article buckets 210 at any one time. The forward or righthand end of the leveling plate 290 as viewed in FIG. 14 has secured thereto a hinged section 291 by means of a hinge 292, the outer end of the hinged section 291 being upturned as at 293 for easier engagement with any elongated articles brought into contact therewith. The leveling plate 290 and its hinged section 291 are positioned just so as to clear the upper edges of the side walls 240 and 260, and therefore serve to level the bundler 60 of elongated articles within each of the article buckets 210.

There also is associated with the hinged leveling section 291 a microswitch 295 having the usual switch arm 296 carrying a contact roller 297 and positioned to actuate a switch plunger 298. If the hinged section 291 is lifted to the dashed line position illustrated in FIG. 14, this indicates an overfilled article bucket 210, whereby the contents thereof would not fit into an associated carton 50. The microswitch 295 serves to turn off all of the conveyors in the cartoner 100, thus to cease operation until the overfilled condition is corrected.

The following is an explanation of the method of operation of the cartoner 100, and particularly the combination article and filler conveyor 200 thereof, particular reference being made to FIGS. 1 to 7 of the drawings. The various conveyors are set into operation including the tippable bucket conveyor 101, the carton conveyor 150 and the combination article and filler conveyor 200, as well as the setting up belts 180. The Hesser product weighers 130 are charged with the elongated articles, such as spaghetti, that are to be weighed thereby into bundles of predetermined weight for placement in the buckets 110. The product weighers 130 place a weighed bundle of articles into alternate ones of the buckets 110 if there are two such product weighers, and into every third bucket 110 if there are three such article weighers, and into every fourth bucket 110 if there are four such product weighers. The carton magazine 160 is filled with cartons 50 in the flattened condition and the expander wheel 165 is set in operation as are the glue applicators 170 and the flap fold mechanisms 175.

As a result of these operations, it will be appreciated that each of the tippable buckets 110 that passes beneath the left-handmost product weigher 130 has a predetermined weight charge of elongated articles therein, an expanded carton 50 is being fed into each carton bucket 155 on the carton conveyor 150, and all parts are in readiness for operation. More specifically, as the article buckets 210 on the conveyor 200 pass around the right-hand sprocket 205, the walls of the buckets 210 are retracted to the maximum position and the filler members 240 associated with the article buckets 210 are in the fully retracted positions.

Referring particularly to FIGS. 4, 5, and 7, as one of the tippable buckets 110 comes into registration with one of the buckets 210, the tippable bucket 110 is tipped by the action of the cam roller 116 in the cam track 120, the bucket 110 being tipped about the pivot shaft 109 in a clockwise direction so as to dump the predetermined weighed charge of articles into the next trailing article bucket 210. Thereafter the cam track 120 returns the tippable bucket 110 to its original upright position again, this being diagrammatically illustrated in FIG. 7.

The article bucket 210 receives the weighed charge of elongated articles therein with the walls 240 and 260 in the fully open position under the control of the cam roller 274 in the cam track 275 (see FIGS. 10 and 11 also). Immediately after the unshaped charge of articles is placed within the article bucket 210, the cam roller 274 is guided by the cam track 275 to close the side walls 240 and 260 to the predetermined positions therefor. At this time an open carton 50 comes into lateral alignment with the article bucket 210. The article bucket 210 then passes beneath the leveling plate hinged section 291 and then under the leveling plate 290, this action together with the closing of the side walls 240 and 260 shaping the bundle 60 of articles in the article bucket 210 so that they will fit within an associated open carton 50. Thereafter the cam roller 287 acting in the cam track 288 (see FIGS. 8 and 9 also) serves to move the filler tip 285 from the fully retracted position to the fully extended position, thus to insert the contents of the article bucket 210 into the aligned open carton 50. Thereafter, the now empty article buckets 210 proceed around the lefthand sprocket 205 and move to the right as viewed in FIG. 5 and then around the righthand sprocket 205, by which time the side walls 240 and 260 have been moved to the fully open positions thereof and the filler tip 285 has been moved to the fully retracted position thereof.

After the shaped bundle of articles has been inserted into the associated open carton 50, the carton 50 passes by the glue applicators 170 which apply glue to certain ones of the flaps on the carton 50, and after which the flaps are engaged by the flap fold mechanisms 175 to close the flaps, and then the setting up belts 180 engage the closed ends of the carton 50 to hold them in this position until the glue sets up to seal the flaps in the closed positions thereof.

It will be appreciated that the cartoner 100 operates continuously and automatically to effect the forming of a predetermined weighed bundle that is unshaped, thereafter shaping the bundle to fit into an associated carton 50, then inserting the shaped bundle into the carton 50 after which the carton 50 is automatically closed and sealed. If for some reason the bundle of elongated articles in one of the article buckets 210 is too large to fit into the associated open carton 50 as detected by the hinged leveling plate 291, then the switch 295 (see FIG. 14) will turn off all of the conveyors so as to prevent injury to any part of the cartoner 100. The overfilled condition can then be corrected and the cartoner 100 again placed into operation by restarting the several conveyors thereof.

The cartoner 100 can be arranged and adjusted to handle several different sizes of bundles 60 for insertion into correspondingly different sizes of cartons 50. Although the lengths of the articles and the carton 50 are constant, the height and width thereof can vary. Different heights of bundles 60 and cartons 50 are accommodated by changing the side wall 240 and 260 so as to provide different heights thereof. Different widths of bundles 60 and cartons 50 are handled by providing different shapes of the cam track 275 guiding the roller 273 so as to position the side walls 240 and 260 at different distances apart in the final closed and shaping positions thereof.

There is illustrated in FIGS. 19 to 30 a second preferred embodiment of a combination article and filler conveyor 300. The conveyor 300 includes two spaced-apart conveyor chains 301 each formed from a plurality of conveyor links 302 interconnected by conveyor pins 303. The chains 301 are supported by sprockets that in turn are mounted on shafts, like the sprockets 205 and the shafts 206 described above. Further, each conveyor chain 301 carries bearing blocks 307 (see FIG. 20) that are supported by support plates 308 so as to maintain the conveyor chains 301 at a predetermined elevation throughout at least the upper reaches thereof.

Mounted on the conveyor chains 301 at spaced intervals are article buckets 310, the article buckets 310 being spaced apart the same distance as the article buckets 210 described above, and specifically are spaced apart the same distance as cooperating carton buckets 155, the carton buckets 155 and the article buckets 310 being in lateral alignment and in vertical alignment.

Figures 27, 28, 29, 30:
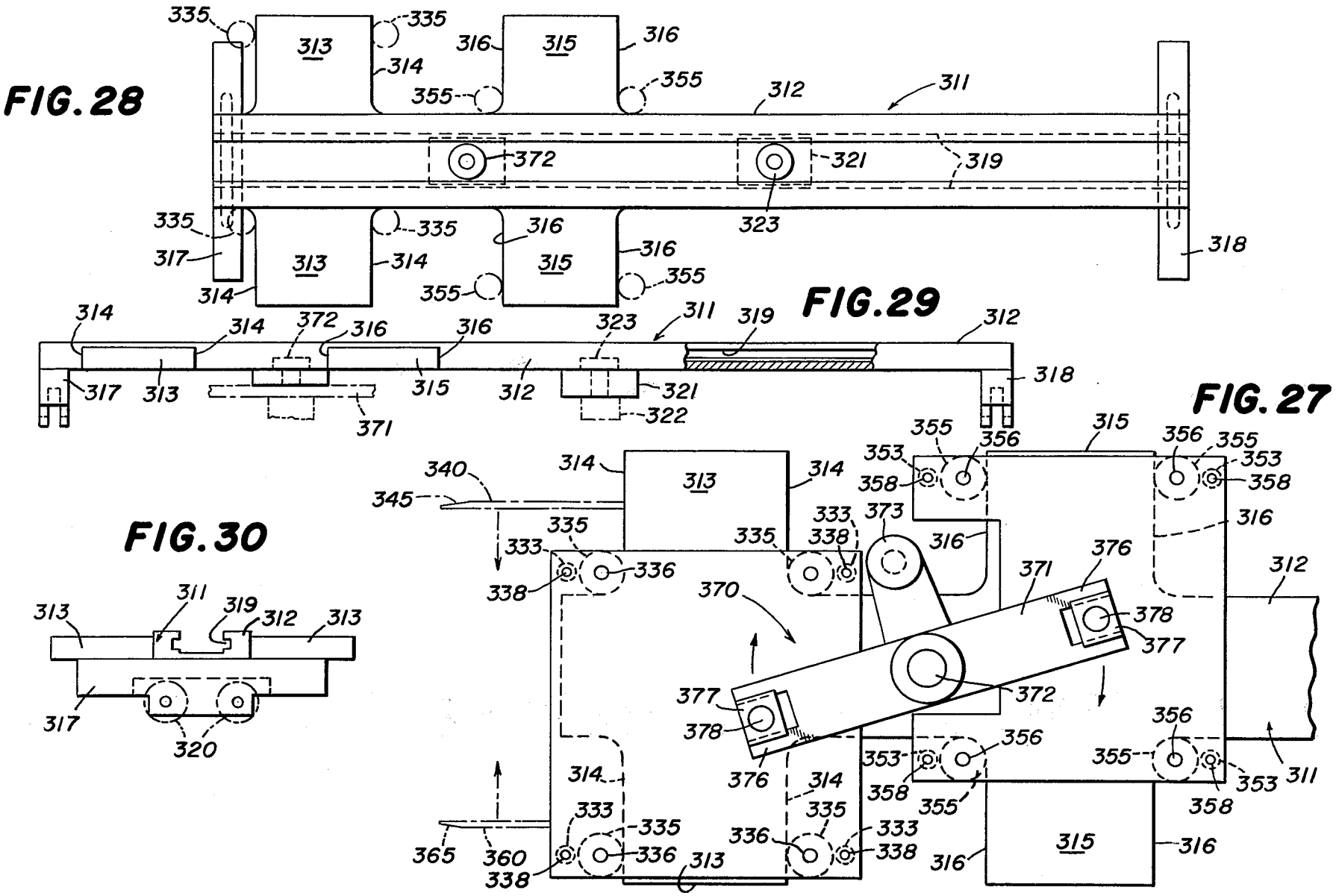
FIG. 27 is a view from the bottom of the mechanism for controlling the position of the sides of the article bucket.
FIG. 28 is a plan view of the article bucket frame and its appendages.
FIG. 29 is a side elevational view of the structure in FIG. 28 with certain portions broken away.
FIG. 30 is an end view of the structure of FIGS. 28 and 29.

Each of the article buckets 310 includes a support base 311, the shape of which is best illustrated in FIGS. 28 and 29 of the drawings, the support base 311 including a longitudinal body 312 having front side arms 313 and rear side arms 315. The front side arms 313 have edges 314 disposed in the direction of travel with the associated article bucket 310, while the rear side arms 315 also have edges 316 aligned in the direction of travel of the article buckets 310. A front support block 317 is provided at one end of the support base 311 and a rear suppot block 318 is provided at the other end, the support blocks 317 and 318 being fixedly secured to the support base 311. Finally, a T-shaped slot 319 extends the entire length of the support base 311 and centrally thereof, see FIG. 30. Each of the support blocks 317 and 318 carries pairs of rollers 320 that rest upon the support plates 308 to be carried thereby, and thus to maintain the associated article bucket 310 at the proper vertical position. There further is provided an intermediate support block 321 that carries a cam roller 322 mounted thereon by a mount 323, the cam roller 320 riding in a cam track 325 that provides for horizontal positioning of the support base 311 and the associated article bucket 310.

The article bucket 310 further comprises a front bottom wall 330 (see FIG. 19) formed of stainless steel since it comes into contact with the spaghetti product being cartoned, and extending upwardly from the forward (top as viewed in FIG. 19) edge thereof is a removable forward side wall 340 also formed of stainless steel. A rear bottom wall 350 is provided immediately to the rear or right, as viewed in FIG. 19, of the front bottom wall 330, the wall 350 also being formed of stainless steel, and carrying an upstanding rearward side wall 360 formed of stainless steel. The bottom walls 330 and 350 shift longitudinally, i.e., in the direction of travel of the conveyor 300, in order to move the attached side walls 340 and 360 toward and away from each other during the shaping of a bundle of elongated articles contained in the article bucket 310.

In order to accommodate the longitudinal shifting of the front bottom wall 330, it has provided therewith a bottom plate 332 (formed of aluminum) and carrying hexagonal spacers 333 mounted on shafts 338 and having oil-impregnated bronze spacers 331 disposed between the ends of the spacers 331 and the associated bottom wall 330 and bottom plate 332. It will be noted that the front side arms 313 are disposed between the front bottom wall 330 and its associated bottom plate 332 to support and guide the same to the spacers 331. In order to provide a positive guide and a smooth movement of the front bottom wall 330 and the attached side wall 340 along the side arms 313, four rollers 335 are provided mounted between the front bottom wall 330 and its bottom plate 332, the rollers 335 being mounted on shafts 336 and preferably being of the form known as McGill rollers. It further is pointed out with reference to FIG. 20 that the lefthand edge of the front bottom wall 330 is beveled on the lower side as at 337 to provide for better engagement with the associated carton 50 on the adjacent carton conveyor 150.

The mounting of the forward side wall 340 on the front bottom wall 330 is best illustrated in FIGS. 19 and 20 of the drawings. Fixedly secured to the front bottom wall 330 is a brass angle iron 341 on which is disposed a mounting plunger 343 which is hand operable, the plunger 343 being disposed in a mounting member 342 on the brass angle iron 341, and particularly the wall thereof extending upwardly. Suitable fasteners 344 secure the lower flange of the brass angle iron 341 to the front bottom wall 330. The forward side wall 340 carries a pair of mounting brackets 346 which fit around the opposite ends of the vertical flange of the brass angle iron 341, and the mounting plunger 343 has an end thereof disposed in an opening in the forward side wall 340, the forward end in the opening not being illustrated. The forward or lefthand end of the side wall 340 is beveled as at 345 to make better and easier engagement with the associated carton 50, and particularly the flaps thereof.

The rear bottom wall 350 is mounted for sliding movement on the rear side arms 315, and to this end is provided with a bottom plate 352 held in position by a plurality of hexagonal spacers 353 supported on shafts 358 disposed between the bottom wall 350 and its bottom plate 352, suitable bronze spacers 351 like the spacers 331 being interposed as shown in the drawings. As a result, the rear bottom wall 350 is mounted for sliding movement on the associated rear side arm 315 with the bronze spacers 351 contacting the opposed surfaces of the rear side arms 315. To further guide movement of the bottom wall 350 on the associated rear side arms 315, four rollers 355 have been provided mounted on shafts 356, the rollers 355 engaging the edges 316 on the rear side arms 315 (see FIGS. 22 and 23).

The rearward side wall 360 is mounted on the rear bottom wall 350 by means of a brass angle iron 361. More specifically, the horizontal flange of the brass angle iron 361 is secured to the rear bottom wall 350 by suitable fasteners 364. The vertical leg of the brass angle iron 361 carries a mounting member 362 having a mounting plunger 363 that is manually operable. The rearward side wall 360 carries two spaced-apart mounting brackets 366 that engage the opposite ends of the vertical flange of the brass angle iron 361 for engagement therewith, the forward end of the mounting plunger (not shown) engaging in an opening (not shown) in the rearward side wall 360 to maintain the wall 360 in its mounted position.

Figure 22:
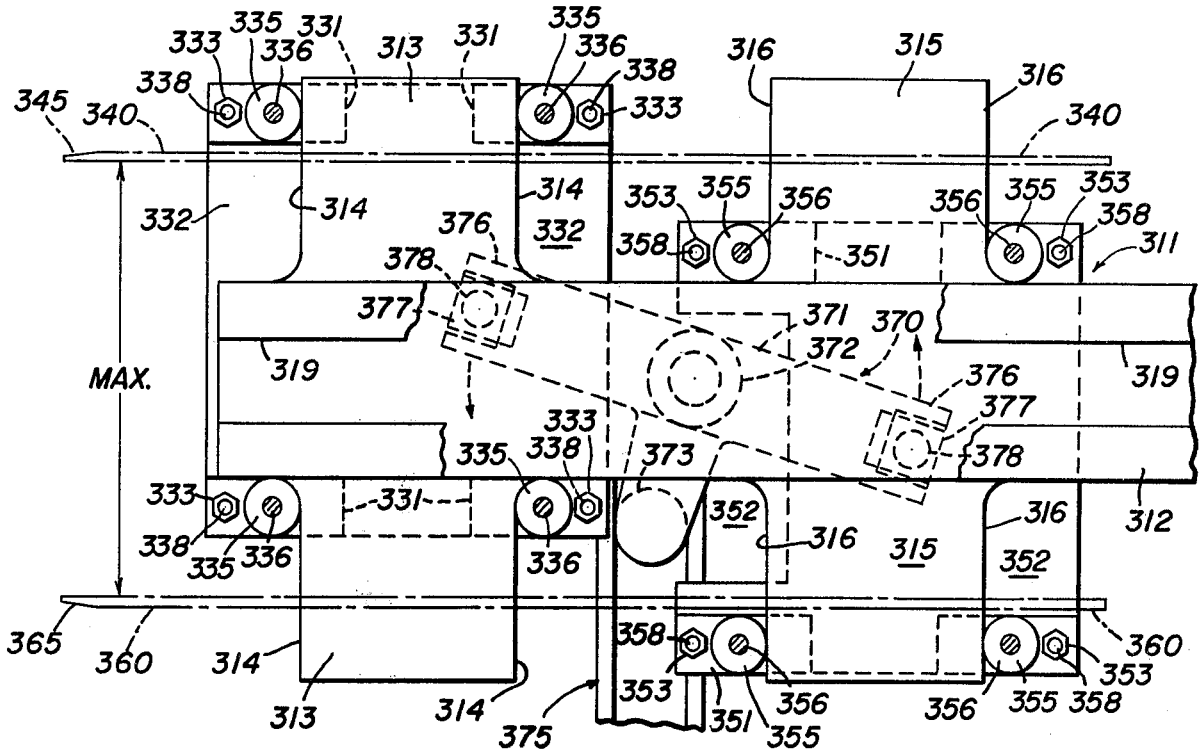
FIG. 22 is a further enlarged view with certain parts broken away and removed illustrating the mechanism for moving the walls of the article bucket of FIG. 19, the parts being shown with the walls in the maximum spaced apart condition thereof.
Figure 23:
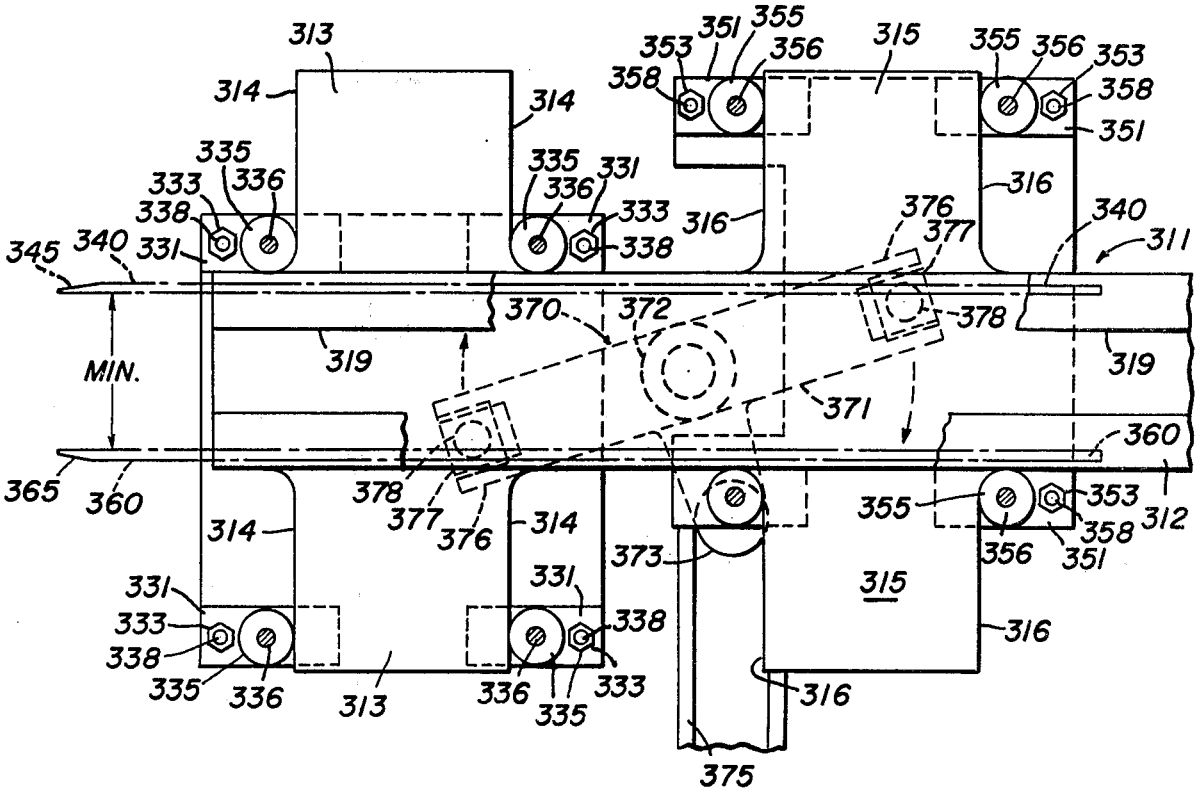
FIG. 23 is a view similar to FIG. 22 but showing the walls in the minimum spaced apart condition thereof.
Figure 24:
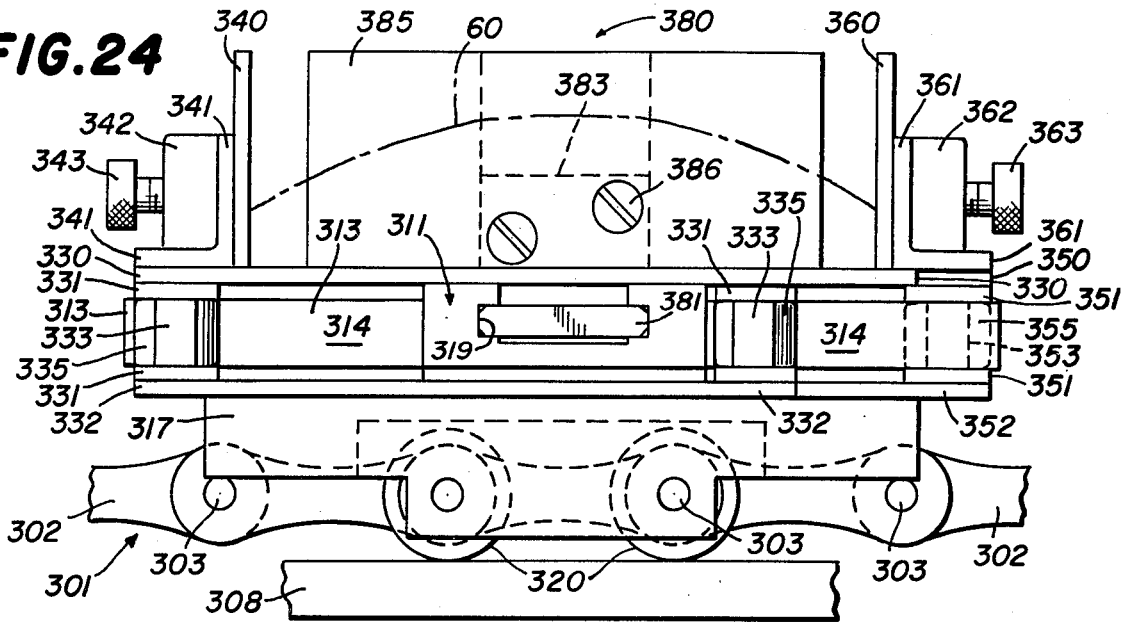
FIG. 24 is a view on an enlarged scale from the left-hand end of the article bucket of FIG. 19.

The side walls 340 and 360 are movable between the positions illustrated respectively in FIGS. 22 and 23, i.e., between a maximum open position illustrated in FIG. 22 and a minimum closed position illustrated in FIG. 23. To this end, a wall positioning mechanism 370 has been provided including an essential T-shaped lever 371 pivotally mounted as at 372 on the support base 311. A roller 373 is provided on the shorter arm of the lever 371 and engages in a cam track 375 (see FIG. 25 particularly). The other ends of the T-shaped lever 371 are forked as at 376 and each carry a block 377 slidable with respect thereto within the forked ends 376, the blocks 377 being secured to the associated bottom plates 332 and 352, respectively, by pivot pins 387. By properly shaping the cam track 375, the bottom walls 330 and 350 together with the associated side walls 340 and 360 can be moved between the maximum spaced-apart position of FIG. 22 and the minimum spaced-apart position of FIG. 23, and any position therebetween.

In order to deliver a shaped bundle 60 of elongated articles from the article bucket 310, each article bucket 310 has associated therewith a filler member 380. More specifically, there is provided in the T-shaped slot 319 in each support base 311 a slide 381 (see FIGS. 19 and 20), the righthand end of the slide 381 extending beyond the support base 311 and carrying a block 382 to which is secured an arm 383 that extends from the block 382 to the left and carries on the left-hand end thereof, as viewed in FIGS. 19 and 20, a filler tip 385. The filler tip 385 is secured in place by screws 386 so that the filler tip 385 can be changed when required so as to accommodate different widths of bundles 60 and different widths of cartons 50. The block 382 also carries a cam roller 387 engaging in a cam track 388, the shape of the cam track 388 being like that of the cam track 288 illustrated in FIGS. 4 and 5 above and serving to push the contents of the article bucket 310 into an associated carton 50 as has been described hereinabove with respect to the filler member 280.

Figure 26:
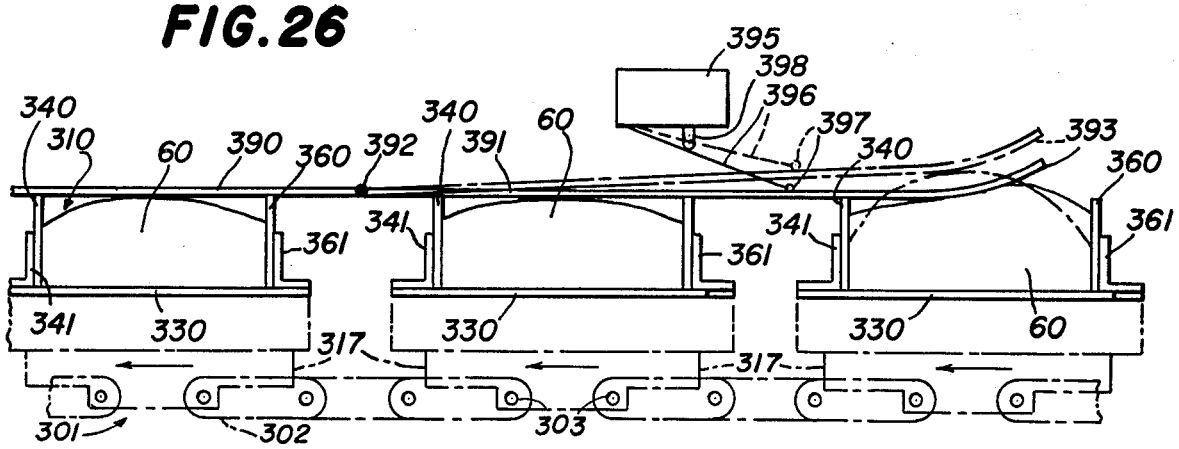
FIG. 26 is a partially diagrammatic view showing several of the article buckets of FIGS. 19 and 20 with movable walls and the association thereof with the leveling plate disposed thereabove.

There is illustrated in FIG. 26 of the drawings a leveling plate 390 which is positioned to contact the bundle of elongated articles before the side walls 340 and 360 have moved to the inner and shaping positions thereof. The leveling plate 390 has a width essentially equal to that of the associated article buckets 310 and covers a plurality of the article buckets 310 at any one time. The forward or righthand end of the leveling plate 390 as viewed in FIG. 26 has secured thereto a hinged section 391 by means of a hinge 392, the outer end of the hinged section 391 being upturned as at 393 for easier engagement with any elongated articles brought into contact therewith. The leveling plate 390 and its hinged section 391 are positioned just so as to clear the upper edges of the side walls 340 and 360, and therefore serve to level the bundle 60 of elongated articles within each of the article buckets 310.

There also is associated with the hinged leveling section 391 a microswitch 395 having the usual switch arm 396 carrying a contact roller 397 and positioned to actuate a switch plunger 398. If the hinged section 391 is lifted to the dashed line position illustrated in FIG. 26, this indicates an overfilled article bucket 310, whereby the contents thereof would not fit into the associated carton 50. The microswitch 395 serves to turn off all of the conveyors in the cartoner 100, thus to cease operations until the overfilled condition is corrected.

The following is an explanation of the method of operation of the cartoner 100 using the combination article and filler conveyor 300. Reference is made to FIGS. 1 to 7 of the drawings, as well as to FIGS. 19 to 30 thereof. The various conveyors are set into operation including the tippable bucket conveyor 101, the carton conveyor 150 and the combination article and filler conveyor 300, as well as the setting up belts 180. The Hesser product weighers 130 are charged with the elongated articles, such as spaghetti, that are to be weighed thereby into bundles of predetermined weight for placement in the buckets 110. The product weighers 130 place a weighed bundle of articles into alternate ones of the buckets 110 if there are two such product weighers, and into every third bucket 110 if there are three such product weighers, and into every fourth bucket 110 if there are four such product weighers. The carton magazine 160 is filled with cartons 50 in the flattened condition and the expander wheel 165 is set in operation as is the glue applicator 170 and the flap fold mechanism 175.

As a consequence of these operations, each of the tippable buckets 110 that passes beneath the left-handmost product weigher 130 has a predetermined weight charge of elongated articles therein, an expanded carton 50 is being fed into each carton bucket 155 on the carton conveyor 150, and all parts are in readiness for operation. More specifically, as the article buckets 310 on the conveyor 300 pass around the righthand sprocket therefor, the walls of the buckets 310 are retracted to the maximum position and the filler members 380 associated with the article buckets 310 are in the fully retracted position.

As was illustrated in FIGS. 4, 5, and 7, as one of the tippable buckets 110 comes into registration with one of the buckets 310, the tippable bucket 110 is tipped by the action of the cam roller 116 on the cam track 120, the bucket 110 being tipped about the pivot shaft 109 in a clockwise direction so as to dump the predetermined weighed charge of articles into the next trailing article bucket 310. Thereafter the cam track 120 returns the tippable bucket to its original upright position, this action being diagrammatically illustrated in FIG. 7.

Figure 25:
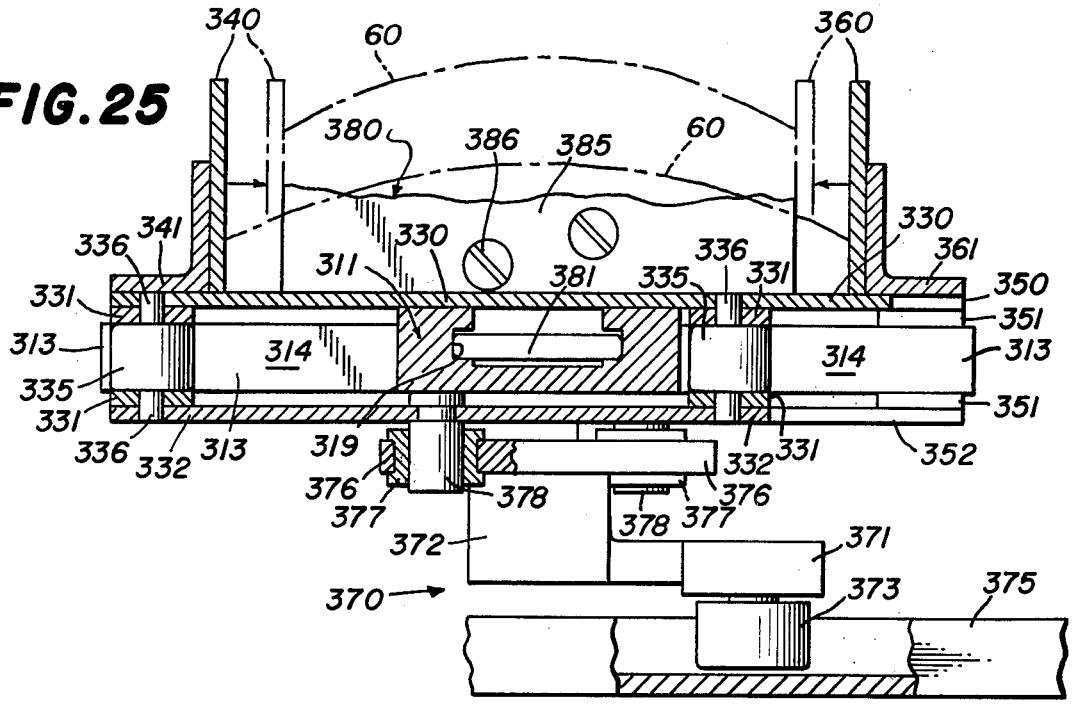
FIG. 25 is an enlarged view in vertical section along the line 25—25 of FIG. 19.

The article bucket 310 receives the weighed charge of elongated articles therein with the walls 340 and 360 in the fully open position under the control of the cam roller 374 in the cam track 375 (see FIGS. 22, 23, and 25 also). Immediately after the unshaped charge of articles is placed within the article bucket 310, the cam roller 374 is guided by the cam track 375 to close the side walls 340 and 360 to the predetermined positions therefor. At this time, an open carbon 50 comes into lateral alignment with the article bucket 310. The article bucket 310 then passes beneath the leveling plate hinged section 391 and then under the leveling plate 390 (see FIG. 26), this action together with the closing of the side walls 340 and 360 shaping the bundle 60 of articles in the article bucket 310 so that they will fit within an associated open carton 50. Thereafter, the cam roller 387 acting in the cam track 388 (see FIGS. 19 and 20 also) serves to move the filler tip 385 from the fully retracted position to the fully extended position thus to insert the contents of the article bucket 310 into the aligned open carton 50. Thereafter, the now empty article buckets 310 proceed around the lefthand sprocket therefor and move to the right and then around the righthand sprocket 205 by which time the side walls 340 and 360 have been moved to the fully open position thereof and the filler tip 385 has been moved to the fully retracted position thereof.

After the shaped bundle of articles has been inserted into the associated open carton 50, the carton 50 passes by the glue applicators 170 which apply glue to certain ones of the flaps on the carton 50, and after which the flaps are engaged by the flap fold mechanisms 175 to close the flaps, and then the setting up belts 180 engage the closed ends of the carton to hold them in this position until the glue sets up to seal the flaps in the closed positions thereof.

It will be appreciated that the cartoner 100 when equipped with the combination article and filler conveyor 300 operates continuously and automatically to effect the forming of a predetermined weighed bundle that is unshaped, thereafter shaping the bundle to fit into an associated carton 50, then inserting the shaped bundle into the carton 50 after which the carton 50 is automatically closed and sealed. If for some reason the bundle of elongated articles in one of the article buckets 310 is too large to fit into the associated open carton 50, as detected by the hinged leveling plate 391, then the switch 395 (see FIG. 26) will turn off all the conveyors so as to prevent injury to any part of the cartoner 100. The overfilled condition can then be corrected and the cartoner 100 again placed into operation by restarting the several conveyors thereof.

The combination article and filler conveyor 300 can be adjusted to accommodate bundles 60 for placement in cartons 50 that have different widths and heights. Different heights of bundles are handled by changing the removable side walls 340 and 360 on the article buckets 310. This is accomplished using the manually retractable plungers 343 and 363. Different widths of bundles 60 and cartons 50 are handled by changing the cam track 375 so as to place the side walls 340 and 360 in the desired adjusted closed and shaping position.

While there have been described what are at present considered to be the preferred embodiments of the invention, it will be understood that various modifications may be made therein, and it is intended to cover in the appended claims all such modifications as fall within the true spirit and scope of the invention.

I claim:

1. Handling mechanism for predetermined unshaped bundles of elongated articles comprising a source of a series of predetermined unshaped bundles of elongated articles, a first continuous conveyor having a set of first article buckets thereon, said first conveyor having a first reach adjacent to said source of unshaped bundles of articles, said set of first article buckets while traveling along said first reach of said first conveyor each receiving an unshaped bundle of articles therein, a second continuous conveyor having thereon a set of second article buckets each including a bottom wall and two opposed side walls, each of said second article buckets having at least one of said side walls shiftable with respect to the other side wall between a retracted receiving position and a closed shaping position, said second conveyor having a first reach adjacent to said first reach of said first conveyor, said set of second article buckets while traveling along said first reach of said second conveyor each receiving an unshaped bundle of articles therein from an associated one of said first buckets, and control mechanism for said second article buckets for placing said one side wall in the retracted receiving position while receiving an unshaped bundle of articles in the associated second article bucket and for thereafter moving said one side wall to the closed shaping position thereof to arrange the unshaped bundle into a bundle having a predetermined desired shape.

2. The handling mechanism set forth in claim 1, wherein said source of a series of predetermined unshaped bundles of elongated articles is two machines for weighing predetermined weights of elongated fragile articles into each unshaped bundle, said weighing machines placing the unshaped bundles into alternate ones of said first article buckets on said first conveyor.

3. The handling mechanism set forth in claim 1, wherein said first article buckets have a fixed size and shape and are each tiltably mounted on said first conveyor for tilting between a bundle receiving position and a bundle dumping position wherein the unshaped bundle is dumped into one of said article buckets.

4. The handling mechanism set forth in claim 1, wherein said second article buckets are disposed below an associated first article bucket along said first reach of said second conveyor.

5. The handling mechanism set forth in claim 1, and further comprising removable opposed side walls for changing the height thereof and thus to change the size of the shaped bundle that can be formed thereby.

6. The handling mechanism set forth in claim 1, wherein the position of said one side wall in the closed shaping position thereof is adjustable to accommodate different sizes of shaped bundles.

7. The handling mechanism set forth in claim 1, wherein each of said second article buckets has a bottom wall and two opposed side walls, both of said opposed side walls being shiftable with respect to said bottom wall and toward and away from each other between retracted receiving positions and closed shaping positions.

8. The handling mechanism set forth in claim 7, and further comprising removable opposed side walls for changing the height thereof and thus to change the size of the shaped bundle that can be formed thereby.

9. The handling mechanism set forth in claim 7, wherein the closed shaped position of said side walls is adjustable so as to accommodate different sizes of shaped bundles therebetween.

10. A combination article handling and filler mechanism for receiving a series of predetermined unshaped bundles of elongated articles from a source thereof and shaped the bundles to a predetermined desired shape and thereafter inserting the same into open cartons on an associated carton conveyor, said article handling and filler mechanism comprising a continuous feed conveyor having thereon a set of article buckets each including a bottom wall and two opposed side walls, each of said article buckets having at least one of said side walls shiftable with respect to the other side wall thereof between a retracted receiving position and a closed shaping position, said feed conveyor having a first reach adjacent to the associated source of a series of predetermined unshaped bundles of articles, said article buckets while traveling along said first reach of said feed conveyor each receiving an unshaped bundle of articles therein from the associated source, a set of filler members mounted upon said feed conveyor and each having a filler tip in alignment with one of said article buckets and shiftable between a retracted receiving position and an extended filling position, and control mechanism for said article buckets for moving the one side wall thereof between the retracted receiving position and the closed shaping position thereof and for moving said filler member between the retracted receiving position and the extended filling position thereof, said control mechanism placing said one side wall for each article bucket in the retracted receiving position for receiving an unshaped bundle of articles therein and thereafter moving said one side wall to the closed shaping position thereof to arrange the unshaped bundle into a bundle having a predetermined desired shape, said control mechanism also placing said filler member in the retracted receiving position thereof for receiving an unshaped bundle of articles in the associated article bucket and while the one side wall thereof moves to the closed shaping position thereof and thereafter moving said filler member to the extended filling position thereof to eject the shaped bundle of articles from the associated article bucket and into a carton on the adjacent carton conveyor.

11. The combination article handling and filler mechanism set forth in claim 10, and further comprising removable opposed side walls for changing the height thereof and thus to change the size of the shaped bundle that can be formed thereby.

12. The combination article handling and filler mechanism set forth in claim 10, wherein the position of said one side wall in the closed shaping position thereof is adjustable to accommodate different sizes of shaped bundles.

13. The combination article handling and filler mechanism set forth in claim 10, wherein each of said article buckets has a bottom wall and two opposed side walls, both of said opposed side walls being shiftable with respect to said bottom wall and toward and away from each other between retracted receiving positions and the closed shaping positions.

14. The combination article handling and filler mechanism set forth in claim 13, and further comprising removable opposed side walls for changing the height thereof and thus to change the size of the shaped bundle that can be formed thereby.

15. The combination article handling and filler mechanism set forth in claim 13, wherein the closed shaping position of said side walls being adjustable so as to accommodate different sizes of shaped bundles therebetween.

16. The combination article handling and filler mechanism set forth in claim 10, wherein said filler tips essentially close the adjacent end of the associated article bucket when said one wall is in the closed shaping position thereof.

17. Handling mechanism for predetermined unshaped bundles of elongated articles comprising a source of a series of predetermined unshaped bundles of elongated articles, a first continuous conveyor having a set of first article buckets thereon, said first conveyor having a first reach adjacent to said source of unshaped bundles of articles, said set of first article buckets while traveling along said first reach of said first conveyor each receiving an unshaped bundle of articles therein, a second continuous conveyor having thereon a set of second article buckets each including a bottom wall and two opposed side walls, each of said second article buckets having at least one of said side walls shiftable with respect to the other of said side walls thereof between a retracted receiving position and a closed shaping position, said second conveyor having a first reach adjacent to said first reach of said first conveyor, said set of second article buckets while traveling along said first reach of said second conveyor each receiving an unshaped bundle of articles therein from an associated one of said first buckets, a set of filler members mounted upon said second conveyor and each having a filler tip in alignment with one of said second article buckets and shiftable between a retracted receiving position and an extended filling position, and control mechanism for said second article buckets for moving the one side wall thereof between the retracted receiving position and the closed shaping position thereof and for moving said filler member between the retracted receiving position and the extended filling position thereof, said control mechanism placing said one side wall for each second article bucket in the retracted receiving position for receiving an unshaped bundle of articles therein and thereafter moving said one side wall to the closed shaping position thereof to arrange the unshaped bundle into a bundle having a predetermined desired shape, said control mechanism also placing said filler member in the retracted receiving position thereof for receiving an unshaped bundle of articles in the associated second article bucket and while the one side wall thereof moves to the closed shaping position thereof and thereafter moving said filler member to the extended filling position thereof to eject the shaped bundle of articles from the associated second article bucket.

18. A combination article handling and filler mechanism for receiving a series of predetermined unshaped bundles of elongated articles from a source thereof and shaping the bundles to a predetermined desired shape and thereafter inserting the same into open cartons on an associated carton conveyor, said article handling and filler mechanism comprising a continuous feed conveyor having thereon a set of article buckets each including a bottom wall and two opposed side walls, each of said article buckets having at least one of said side walls shiftable with respect to the other of said side walls between a retracted receiving position and a closed shaping position, said feed conveyor having a first reach adjacent to the associated source of a series of predetermined unshaped bundles of articles, said article buckets while traveling along said first reach of said feed conveyor each receiving an unshaped bundle of articles therein from the associated source, a leveling plate mounted adjacent to said feed conveyor at a point therealong reached by said article buckets after said one side wall is in the closed shaping position thereof and positioned just above the upper edges of the walls of the article buckets to level the bundle of articles therein, a set of filler members mounted upon said feed conveyor and each having a filler tip in alignment with one of said article buckets and shiftable between a retracted receiving position and an extended filling position, and control mechanism for said article buckets for moving the one side wall thereof between the retracted receiving position and the closed shaping position thereof and for moving said filler member between the retracted receiving position and the extended filling position thereof, said control mechanism placing said one side wall for each article bucket in the retracted receiving position for receiving an unshaped bundle of articles therein and thereafter moving said one side wall to the closed shaping position thereof to arrange the unshaped bundle into a bundle having a predetermined desired shape, said control mechanism also placing said filler member in the retracted receiving position thereof for receiving an unshaped bundle of articles in the associated article bucket and while the one side wall thereof moves to the closed shaping position thereof and the associated article bucket moves beneath said leveling plate and thereafter moving said filler member to the extended filling position thereof to eject the shaped and leveled bundle of articles from the associated article bucket and into a carton on the adjacent carton conveyor.

19. The combination article handling and filler mechanism set forth in claim 18, wherein said leveling plate extends over a plurality of said article buckets when the one side wall thereof is in the closed shaping position thereof.

20. The combination article and filler mechanism set forth in claim 18, wherein said leveling plate has the end thereof first contacting the articles in an article bucket turned upwardly away from the associated article bucket.

21. The combination article handling and filler mechanism set forth in claim 18, wherein said leveling plate has the end thereof disposed toward the oncoming article buckets hinged so as to facilitate the leveling action.

22. A combination article handling and filler mechanism for receiving a series of predetermined unshaped bundles of elongated articles from a source thereof and shaping the bundles to a predetermined desired shape and thereafter inserting the same to open cartons on an associated carton conveyor, said article handling and filler mechanism comprising a continuous feed conveyor having a set of article buckets thereon, each of said article buckets having at least one wall shiftable with respect to the other walls thereof between a retracted receiving position and a closed shaping position, said feed conveyor having a first reach adjacent to the associated source of a series of predetermined unshaped bundles of articles, said article buckets while traveling along said first reach of said feed conveyor each receiving an unshaped bundle of articles therein from the associated source, a leveling plate mounted adjacent to said feed conveyor at a point therealong reached by said article buckets before said one wall is in the closed shaping position thereof and positioned just above the upper edges of the walls of the article buckets, a hinged section on said leveling plate hinged to the end thereof disposed toward the oncoming article buckets and engaging the articles therein to assist in leveling the same within the associated article bucket, a set of filler members mounted upon said feed conveyor and each having a filler tip in alignment with one of said article buckets and shiftable between a retracted receiving position and an extended filling position, a first control mechanism for said article buckets for moving the one wall thereof between the retracted receiving position and the closed shaping position thereof and for moving said filler member between the retracted receiving position and the extended filling position thereof, a second control mechanism responsive to an upward tilting of said hinged section due to the contact thereof with an excess quantity of articles in an article bucket thereunder for stopping said feed conveyor, said first control mechanism placing said one wall for each article bucket in the retracted receiving position for receiving an unshaped bundle of articles therein and thereafter moving said one wall to the closed shaping position thereof to arrange the unshaped bundle into the proper width, said first control mechanism also placing said filler member in the retracted receiving position thereof for receiving an unshaped bundle of articles in the associated article bucket after which the associated article bucket moves beneath said leveling plate and thereafter the one wall thereof moves to the closed shaping position and said filler member then moves to the extended filling position thereof to eject the shaped and leveled bundle of articles from the associated article conveyor and into a carton on the adjacent carton conveyor.

23. A cartoner for bundles of elongated articles received from a source thereof, said cartoner comprising a continuous feed conveyor having thereon a set of article buckets each including a bottom wall and two opposed side walls, each of said article buckets having at least one of said side walls shiftable with respect to the other of said side walls between a retracted receiving position and a closed shaping position, said feed conveyor having a first reach adjacent to the associated source of a series of predetermined unshaped bundles of articles, said article buckets while traveling along said first reach of said feed conveyor each receiving an unshaped bundle of articles therein from the associated source, a set of filler members mounted upon said feed conveyor and each having a filler tip in alignment with one of said article buckets and shiftable between a retracted receiving position and an extended filling position, a carton conveyor for conveying open cartons from a source thereof along a first reach wherein an open carton is in lateral alignment with each of said article buckets having the one wall thereof in the closed shaping position thereof, and control mechanism for said article buckets for moving the one side wall thereof between the retracted receiving position and the closed shaping position thereof and for moving said filler member between the retracted receiving position and the extended filling position thereof, said control mechanism placing said one side wall in each article bucket in the retracted receiving position for receiving an unshaped bundle of articles therein and thereafter moving said one side wall to the closed shaping position thereof to arrange the unshaped bundle into a bundle having a predetermined desired shape, said control mechanism also placing said filler member in the retracted receiving position thereof for receiving an unshaped bundle of articles in the associated article bucket and while the one side wall thereof moves to the closed shaping position thereof and thereafter moving said filler member to the extended filling position thereof to eject the shaped bundle of articles from the associated article bucket and into the open carton on the adjacent reach of said carton conveyor.

24. The cartoner set forth in claim 23, and further comprising a carton magazine for unexpanded cartons mounted adjacent to said carton conveyor, an extractor mounted adjacent to said carton conveyor for extracting a folded carton therefrom, an expander wheel adjacent to said extractor for opening the unexpanded carton and depositing it on said carton conveyor.

25. The cartoner set forth in claim 23, and further comprising a glue applicator for applying glue to certain of the flaps on a carton carried by said carton conveyor after insertion of the elongated articles therein, flap folding mechanism adjacent to said carton conveyor for folding the carton flaps with the glue thereon into the folded position, and setting up mechanism engaging the folded flaps to hold them in the folded position while the glue thereon sets up.

26. A cartoner for bundles of elongated articles received from a source thereof, siad cartoner comprising a continuous feed conveyor having thereon a set of article buckets each including a bottom wall and two opposed side walls, each of said article buckets having at least one of said side walls shiftable with respect to the other of said side walls between a retracted receiving position and a closed shaping position, said feed conveyor having a first reach adjacent to the associated source of a series of predetermined unshaped bundle of articles, said article buckets while traveling along said first reach of said feed conveyor each receiving an unshaped bundle of articles therein from the associated source, a leveling plate mounted adjacent to said feed conveyor at a point therealong reached by said article buckets while said one side wall is in the retracted receiving position thereof and positioned just above the edges of the walls of the article buckets to level the bundle of articles therein, a set of filler members mounted upon said feed conveyor and each having a filler tip in alignment with one of said article buckets and shiftable beteen a retracted receiving position and an extended filling position, a carton conveyor for conveying open cartons from a source thereof along a first reach wherein an open carton is in lateral alignment with each of said article buckets having the one side wall thereof in the closed shaping position thereof, and control mechanism for said article buckets for moving the one side wall thereof between the retracted receiving position and the closed shaping position thereof and for moving said filler member between the retracted receiving position and the extended filling position thereof, said control mechanism placing said one side wall in each article bucket in the retracted receiving position for receiving an unshaped bundle of articles therein and thereafter moving said one side wall to the closed shaping position thereof to arrange the unshaped bundle into a bundle having a predetermined desired shape, said control mechanism also placing said filler member in the retracted receiving position thereof for receiving an unshaped bundle of articles in the associated article bucket after which the associated article bucket moves beneath said leveling plate and thereafter the one side wall thereof moves to the closed shaping position and said filler member then moves to the extended filling position thereof to eject the shaped and leveled bundle of articles from the associated article bucket and into the open carton on the adjacent reach of said carton conveyor.

27. The cartoner set forth in claim 26, and further comprising a carton magazine for unexpanded cartons mounted adjacent to said carton conveyor, an extractor mounted adjacent to said carton conveyor for extracting an unexpanded carton therefrom, an expander wheel adjacent to said extractor for opening the folded carton and depositing it on said carton conveyor.

28. The cartoner set forth in claim 26, and further comprising a glue applicator for applying glue to certain of the flaps on a carton carried by said carton conveyor after insertion of the elongated articles therein, flap folding mechanism adjacent to said carton conveyor for folding the carton flaps with glue thereon into the folded position, and setting up mechanism engaging the folded flaps to hold them in the folded position while the glue thereon sets up.

29. A cartoner for bundles of elongated articles received from a source thereof, said cartoner comprising a continuous feed conveyor having a set of article buckets thereon, each of said article buckets having at least one wall shiftable with respect to the other walls thereof between a retracted receiving position and a closed shaping position, said feed conveyor having a first reach adjacent to the associated source of a series of predetermined unshaped bundle of articles, said article buckets while traveling along said first reach of said feed conveyor each receiving an unshaped bundle of articles therein from the associated source, a leveling plate mounted adjacent to said feed conveyor at a point therealong reached by said article buckets while said one wall is in the retracted receiving position thereof and positioned just above the upper edges of the walls of the article buckets, a hinged section on said leveling plate hinged to the end thereof disposed toward the oncoming article buckets and engaging the articles therein to assist in leveling the same within the associated article bucket, a set of filler members mounted upon said feed conveyor and each having a filler tip in alignment with one of said article buckets and shiftable between a retracted receiving position and an extended filling position, a carton conveyor for conveying open cartons from a source thereof along a first reach wherein an open carton is in lateral alignment with each of said article buckets having the one wall thereof in the closed shaping position thereof, a first control mechanism for said article buckets for moving the one wall thereof between the retracted receiving position and the closed shaping position thereof and for moving said filler member between the retracted receiving position and the extended filling position thereof, a second control mechanism responsive to an upward tilting of said hinged section due to the contact thereof with an excess quantity of articles in an article bucket thereunder for stopping said feed conveyor, said first control mechanism placing said one wall for each article bucket in the retracted receiving position for receiving an unshaped bundle of articles therein and thereafter moving said one wall to the closed shaping position thereof to arrange the unshaped bundle into the proper width, said first control mechanism also placing said filler member in the retracted receiving position thereof for receiving an unshaped bundle of articles in the associated article bucket after which the associated article bucket moves beneath said leveling plate and thereafter the one wall thereof moves to the closed shaping position and said filler member then moves to the extended filling position thereof to eject the shaped and leveled bundle of articles from the associated article bucket and into the open carton on the adjacent reach of said carton conveyor.

30. A cartoner for bundles of elongated articles comprising a source of a series of predetermined unshaped bundles of elongated articles, a first continuous conveyor having a set of first article buckets thereon, said first conveyor having a first reach adjacent to said source of unshaped bundles of articles, said set of first article buckets while traveling along said first reach of said first conveyor each receiving an unshaped bundle of articles therein, a second continuous conveyor having thereon a set of second article buckets each including a bottom wall and two opposed side walls, each of said second article buckets having at least one of said side walls shiftable with respect to the other of said side walls between a retracted receiving position and a closed shaping position, said second conveyor having a first reach adjacent to said first reach of said first conveyor, said set of second article buckets while traveling along said first reach of said second conveyor each receiving an unshaped bundle of articles therein from an associated one of said first buckets, a set of filler members mounted upon said second conveyor and each having a filler tip in alignment with one of said second article buckets and shiftable between a retracted receiving position and an extended filling position, a carton conveyor for conveying open cartons from a source thereof along a first reach wherein an open carton is in lateral alignment with each of said second article buckets having the one side wall thereof in the closed shaping position thereof, and control mechanism for said second article buckets for moving the one side wall thereof between the retracted receiving position and the closed shaping position thereof and for moving said filler member between the retracted receiving position and the extended filling position thereof, said control mechanism placing said one side wall in each second article bucket in the retracted receiving position for receiving an unshaped bundle of articles therein and thereafter moving said one side wall to the closed shaping position thereof to arrange the unshaped bundle into a bundle having a predetermined desired shape, said control mechanism also placing said filler member in the retracted receiving position thereof for receiving an unshaped bundle of articles in the associated second article bucket and while the one side wall thereof moves to the closed shaping position thereof and thereafter moving said filler member to the extended filling position thereof to eject the shaped bundle of articles from the associated second article bucket and into the open carton on the adjacent reach of said carton conveyor.

31. A cartoner for bundles of elongated articles comprising a source of a series of predetermined unshaped bundles of elongated articles, a first continuous conveyor having a set of first article buckets thereon, said first conveyor having a first reach adjacent to said source of unshaped bundles of articles, said set of first article buckets while traveling along said first reach of said first conveyor each receiving an unshaped bundle of articles therein, a second continuous conveyor having a set of second article buckets thereon, each of said second article buckets having at least one wall shiftable with respect to the other walls thereof between a retracted receiving position and a closed shaping position, said second conveyor having a first reach adjacent to said first reach of said first conveyor, said set of second article buckets while traveling along said first reach of said second conveyor each receiving an unshaped bundle of articles therein from an associated one of said first buckets, a leveling plate mounted adjacent to said second conveyor at a point therealong reached by said second article buckets while said one wall is in the retracted receiving position thereof and positioned just above the upper edges of the walls of the second article buckets to level the bundle of articles therein, a set of filler members mounted upon said second conveyor and each having a filler tip in alignment with one of said second article buckets and shiftable between a retracted receiving position and an extended filling position, a carton conveyor for conveying open cartons from a source thereof along a first reach wherein an open carton is in lateral alignment with each of said second article buckets having the one wall thereof in the closed shaping position thereof, and control mechanism for said second article buckets for moving the one wall thereof between the retracted receiving position and the closed shaping position thereof and for moving said filler member between the retracted receiving position and the extended filling position thereof, said control mechanism placing said one wall in each second article bucket in the retracted receiving position for receiving an unshaped bundle of articles therein and thereafter moving said one wall to the closed shaping position thereof to arrange the unshaped bundle into a bundle having a predetermined desired shaped, said control mechanism also placing said filler member in the retracted receiving position thereof for receiving an unshaped bundle of articles in the associated second article bucket and the associated second article bucket moves beneath said leveling plate and thereafter the one wall thereof moves to the closed shaping position and said filler member then moves to the extended filling position thereof to eject the shaped bundle of articles from the associated second article bucket and into the open carton on the adjacent reach of said carton conveyor.

32. A cartoner for bundles of elongated articles comprising a source of a series of predetermined unshaped bundles of elongated articles, a first continuous conveyor having a set of first article buckets thereon, said first conveyor having a first reach adjacent to said source of unshaped bundles of articles, said set of first article buckets while traveling along said first reach of said first conveyor each receiving an unshaped bundle of articles therein, a second continuous conveyor having a set of second article buckets thereon, each of said second article buckets having at least one wall shiftable with respect to the other walls thereof between a retracted receiving position and a closed shaping position, said second conveyor having a first reach adjacent to said first reach of said first conveyor, said set of second article buckets while traveling along said first reach of said second conveyor each receiving an unshaped bundle of articles therein from an associated one of said first buckets, a leveling plate mounted adjacent to said second conveyor at a point therealong reached by said second article buckets while said one wall is in the retracted receiving position thereof and positioned just above the upper edges of the walls of the second article buckets, a hinged section on said leveling plate hinged to the end thereof disposed toward the oncoming second article buckets and engaging the articles therein to assist in leveling the same within the associated second article bucket, a set of filler members mounted upon said second conveyor and each having a filler tip in alignment withone of said second article buckets and shiftable between a retracted receiving position and an extended filling position, a carton conveyor for conveying open cartons from a source thereof along a first reach wherein an open carton is in lateral alignment with each of said second article buckets having the end wall thereof in the closed shaping position thereof, first control mechanism for said second article buckets for moving the one wall thereof between the retracted receiving position and the closed shaping position thereof and for moving said filler member between the retracted receiving position and the extended filling position thereof, second control mechanism responsive to an upward tilting of said hinged section due to the contact thereof with an excess quantity of articles in an article bucket thereunder for stopping said feed conveyor, said first control mechanism placing said one wall for each second article bucket in the retracted receiving position for receiving an unshaped bundle of articles therein and thereafter moving said one wall to the closed shaping position thereof to arrange the unshaped bundle into the proper width, said first control mechanism also placing said filler member in the retracted receiving position thereof for receiving an unshaped bundle of articles in the associated second article bucket and the associated second article bucket moves beneath said leveling plate and thereafter the one wall thereof moves to the closed shaping position and said filler member then moves to the extended filling position thereof to eject the shaped bundle of articles from the associated second article bucket and into the open carton on the adjacent reach of said carton conveyor.

33. Handling mechanism for predetermined unshaped bundles of elongated articles comprising a source of a series of predetermined unshaped bundles of elongated articles, a first continuous conveyor having a set of first article buckets thereon, said first conveyor having a first reach adjacent to said source of unshaped bundles of articles, said set of first articles buckets while traveling along said first reach of said first conveyor each receiving an unshaped bundle of articles therein, a second continuous conveyor having a set of article buckets thereon, each of said second article buckets having at least one wall shiftable with respect to the other walls thereof between a retracted receiving position and a closed shaping position, said second conveyor having a first reach adjacent to said first reach of said first conveyor, said set of second article buckets while traveling along said first reach of said second conveyor each receiving an unshaped bundle of articles therein from an associated one of said first buckets, and control mechanism including a cam track mounted adjacent to said second conveyor and a plurality of cam followers respectively associated with the one wall of each second article bucket and engaging in said cam track to control the position of said one wall of each article bucket, said control mechanism placing said one wall in the retracted receiving position while receiving an unshaped bundle of articles in the associated second article bucket and for thereafter moving said one wall to the closed shaping position thereof to arrange the unshaped bundle into a bundle having a predetermined desired shape.

34. A combination article handling and filler mechanism for receiving a series of predetermined unshaped bundles of elongated articles from a source thereof and shaping the bundles to a predetermined desired shape and thereafter inserting the same into open cartons on an associated carton conveyor, said article handling and filler mechanism comprising a continuous feed conveyor having a set of article buckets thereon, each of said article buckets having at least one wall shiftable with respect to the other walls thereof between a retracted receiving position and a closed shaping position, said feed conveyor having a first reach adjacent to the associated source of a series of predetermined unshaped bundles of articles, said article buckets while traveling along said first reach of said feed conveyor each receiving an unshaped bundle of articles therein from the associated source, a set of filler members mounted upon said feed conveyor and each having a filler tip in alignment with one of said article buckets and shiftable between a retracted receiving position and an extended filling position, and control mechanism including a first cam track mounted adjacent to said feed conveyor and a plurality of first cam followers respectively associated with the one wall of each article bucket and engaging in said first cam track to control the position of said one wall of each article bucket, said control mechanism including a second cam track mounted adjacent to said feed conveyor and a plurality of second cam followers respectively associated with said filler members and engaging in said second cam tracks to control the positions of said filler members, said control mechanism placing said one wall for each article bucket in the retracted receiving position for receiving an unshaped bundle of articles therein and thereafter moving said one wall to the closed shaping position thereof to arrange the unshaped bundle into a bundle having a predetermined desired shape, said control mechanism also placing said filler member in the retracted receiving position thereof for receiving an unshaped bundle of articles in the associated article bucket and while the one wall thereof moves to the closed shaping position thereof and thereafter moving said filler member to the extended filling position thereof to eject the shaped bundle of articles from the associated article bucket and into a carton on the adjacent carton conveyor.

* * * * *

UNITED STATES PATENT AND TRADEMARK OFFICE

CERTIFICATE OF CORRECTION

PATENT NO. : 4,211,054
DATED : July 8, 1980
INVENTOR(S) : Elmer D. Sramek

It is certified that error appears in the above-identified patent and that said Letters Patent are hereby corrected as shown below:

Column 16, line 33, "shaped" should be --shaping--.

Column 20, line 51, "siad" should be --said--;

line 66, after "the" insert --upper--.

Column 21, line 3, "beteen" should be --between--.

Column 23, line 58, "shaped" should be --shape--.

Signed and Sealed this

*Thirtieth* Day of *December 1980*

[SEAL]

*Attest:*

SIDNEY A. DIAMOND

*Attesting Officer*

*Commissioner of Patents and Trademarks*